US011106176B2

(12) United States Patent
Shimizu et al.

(10) Patent No.: US 11,106,176 B2
(45) **Date of Patent: *Aug. 31, 2021**

(54) IMAGE-FORMING APPARATUS PROVIDED WITH DETACHABLE WASTE TONER CONTAINER AND SHEET-CONVEYING GUIDE

(71) Applicant: Brother Kogyo Kabushiki Kaisha, Nagoya (JP)

(72) Inventors: Takashi Shimizu, Nagoya (JP); Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/861,321

(22) Filed: Apr. 29, 2020

(65) Prior Publication Data

US 2020/0257243 A1 Aug. 13, 2020

Related U.S. Application Data

(63) Continuation of application No. 16/362,092, filed on Mar. 22, 2019, now Pat. No. 10,671,016, which is a (Continued)

(30) Foreign Application Priority Data

Mar. 31, 2016 (JP) ..... 2016-073468

(51) Int. Cl.
*G03G 21/18* (2006.01)
*G03G 15/08* (2006.01)
(Continued)

(52) U.S. Cl.
CPC ..... *G03G 21/1814* (2013.01); *G03G 15/0808* (2013.01); *G03G 15/6502* (2013.01);
(Continued)

(58) Field of Classification Search
CPC ..... G03G 21/1814; G03G 15/0808; G03G 15/6502
See application file for complete search history.

(56) References Cited

U.S. PATENT DOCUMENTS 6,418,291 B1 7/2002 Sakemi
8,346,153 B2 1/2013 Ogawa
(Continued)

FOREIGN PATENT DOCUMENTS

JP H04-310967 A 11/1992
JP H08-114984 A 5/1996
(Continued)

OTHER PUBLICATIONS

Jan. 21, 2020—(JP) Notice of Reasons for Refusal—App 2016-073468, Eng Tran.
(Continued)

*Primary Examiner* — Walter L Lindsay, Jr.
*Assistant Examiner* — Andrew V Do
(74) *Attorney, Agent, or Firm* — Banner & Witcoff, Ltd.

(57) ABSTRACT

An image-forming apparatus includes an apparatus body and a process cartridge attachable to and detachable from the apparatus body. The apparatus body includes a sheet-feed roller and a body wall. The process cartridge includes: a photosensitive drum; a drum frame; a developing roller; a cleaner; a conveying pipe and a waste-toner container for storing waste toner removed from the photosensitive drum by the cleaner and conveyed by the conveying pipe. The waste-toner container is detachably mountable on the drum frame. The waste-toner container mounted on the drum frame is positioned opposite to the photosensitive drum with respect to the developing roller. The body wall of the apparatus body and a container wall of the waste-toner container constitute a part of a sheet-conveying guide for
(Continued)

guiding conveyance of a sheet from the sheet-feed roller toward the photosensitive drum when the process cartridge is attached to the apparatus body.

14 Claims, 17 Drawing Sheets

Related U.S. Application Data continuation of application No. 15/466,177, filed on Mar. 22, 2017, now Pat. No. 10,281,872.

(51) Int. Cl.

| | |
|---|---|
| ***G03G 15/00*** | (2006.01) |
| ***G03G 21/00*** | (2006.01) |
| ***G03G 21/12*** | (2006.01) |
| *G03G 21/10* | (2006.01) |

(52) U.S. Cl.

CPC ..... *G03G 21/0005* (2013.01); *G03G 21/12* (2013.01); *G03G 21/1817* (2013.01); *G03G 21/105* (2013.01); *G03G 21/1821* (2013.01); *G03G 2221/0005* (2013.01); *G03G 2221/1624* (2013.01); *G03G 2221/183* (2013.01)

(56) References Cited

U.S. PATENT DOCUMENTS

| | | | |
|---|---|---|---|
| 2009/0269113 | A1 | 10/2009 | Ogawa |
| 2011/0158682 | A1 | 6/2011 | Takagi et al. |
| 2012/0189345 | A1 | 7/2012 | Kim et al. |
| 2015/0050044 | A1 | 2/2015 | Sato |
| 2016/0109827 | A1 | 4/2016 | Yoshida et al. |

FOREIGN PATENT DOCUMENTS

| | | | |
|---|---|---|---|
| JP | 2001-142301 | A | 5/2001 |
| JP | 2009-263103 | A | 11/2009 |
| JP | 2011-118040 | A | 6/2011 |
| JP | 2014-232270 | A | 12/2014 |

OTHER PUBLICATIONS

Apr. 13, 2021—(JP) Notice of Reasons for Refusal—App 2020-072454, Eng Tran.

IMAGE-FORMING APPARATUS PROVIDED WITH DETACHABLE WASTE TONER CONTAINER AND SHEET-CONVEYING GUIDE

CROSS REFERENCE TO RELATED APPLICATION

This application is a continuation of prior U.S. application Ser. No. 16/362,092 filed on Mar. 22, 2019, which is a continuation of prior U.S. application Ser. No. 15/466,177 filed on Mar. 22, 2017, now U.S. Pat. No. 10,281,872, issued May 7, 2019, which claims priority from Japanese Patent Application No. 2016-073468 filed Mar. 31, 2016. The entire content of the priority application is incorporated herein by reference.

TECHNICAL FIELD

The present disclosure relates to an image-forming apparatus.

BACKGROUND

There has been known an image-forming apparatus in which a process cartridge is detachably mountable. The process cartridge includes a photosensitive drum and a developing roller configured to supply toner to the photosensitive drum. The image-forming apparatus includes a sheet-feed roller for feeding a sheet to the photosensitive drum. In such image-forming apparatus, preferably, waste toner left on a peripheral surface of the photosensitive drum is removed therefrom after an image is transferred to each sheet.

For example, Japanese Patent Application Publication No. 2011-118040 discloses a process cartridge including: a cleaner for removing waste toner from a peripheral surface of a photosensitive drum; a conveying pipe for conveying the waste toner removed by the cleaner; and a waste-toner container configured to store the waste toner conveyed by the conveying pipe. In this process cartridge, the waste-toner container is disposed opposite to the photosensitive drum with respect to the developing roller.

SUMMARY

In an image-forming apparatus described in the above-identified reference, a sheet-conveying guide for guiding conveyance of sheets may be provided along a sheet-conveying path between the photosensitive drum and a sheet-feed roller. However, providing such sheet-conveying guide between the photosensitive drum and the sheet-feed roller may result in an increase in size of the image-forming apparatus.

In view of the foregoing, it is an object of the present disclosure to provide a compact image-forming apparatus provided with a sheet-conveying guide in a main body.

In order to attain the above and other objects, the disclosure provides an image-forming apparatus that includes an apparatus body, and a process cartridge attachable to and detachable from the apparatus body. The apparatus body includes a sheet-feed roller, and a body wall. The process cartridge includes a photosensitive drum, a drum frame, a developing roller, a cleaner, a conveying pipe and a waste-toner container. The sheet-feed roller of the apparatus body is configured to convey a sheet toward the photosensitive drum. The drum frame supports the photosensitive drum.

The cleaner is configured to remove waste toner from a peripheral surface of the photosensitive drum. The conveying pipe is configured to convey the waste toner removed by the cleaner. The waste-toner container is detachably mountable on the drum frame. The waste-toner container is configured to store the waste toner conveyed by the conveying pipe. The waste-toner container mounted on the drum frame is positioned opposite to the photosensitive drum with respect to the developing roller. The waste-toner container includes a container wall. The body wall of the apparatus body and the container wall of the waste-toner container constitute a part of a sheet-conveying guide when the process cartridge having the waste-toner container mounted on the drum frame is attached to the apparatus body. The sheet-conveying guide is configured to guide conveyance of the sheet from the sheet-feed roller toward the photosensitive drum.

DETAILED DESCRIPTION

First Embodiment

First, an image-forming apparatus 1 according to a first embodiment of the disclosure will be described with reference to FIGS. 1 through 12.

1. Overview of Image-Forming Apparatus 1

Figure 1:
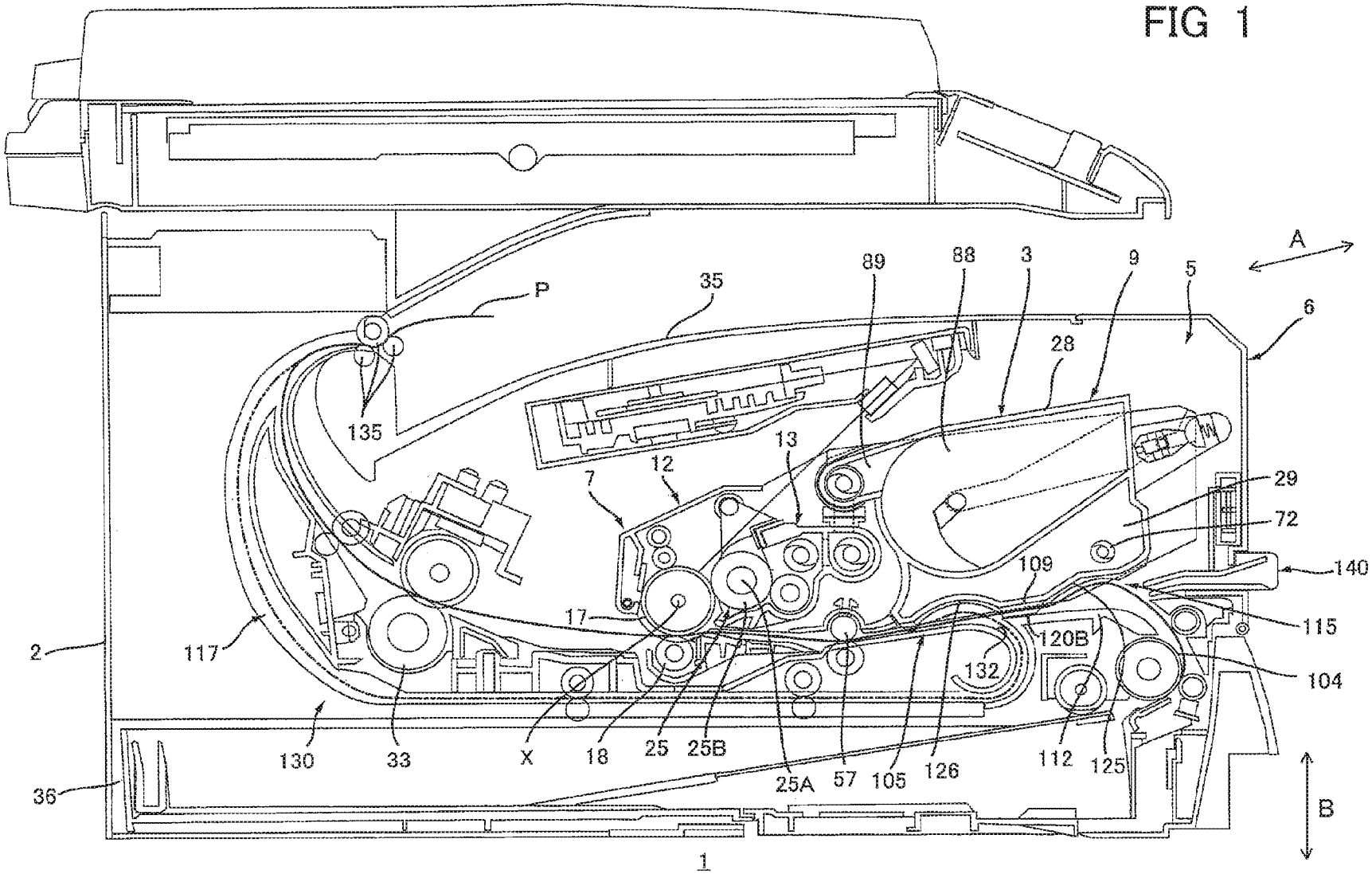
FIG. 1 is a central cross-sectional view of an image-forming apparatus according to a first embodiment, the image-forming apparatus including a process cartridge according to the first embodiment.

As illustrated in FIG. 1, the image-forming apparatus 1 includes an apparatus body 2, a process cartridge 3 attachable to and removable from the apparatus body 2, a transfer roller 18, and a fixing device 33.

In the following description, a direction in which the process cartridge 3 is attached to the apparatus body 2, and a direction in which the process cartridge 3 is detached from the apparatus body 2 will be collectively referred to as "attachment/detachment direction A", wherever necessary. In the present embodiment, the attachment/detachment direction A is generally in coincident with a front-rear direction and indicated by an arrow A in accompanying drawings. Further, a direction crossing the attachment/detachment direction A will be referred to as "crossing direction B." In the present embodiment, the crossing direction B generally coincides with a vertical direction and indicated by an arrow B in the drawings.

1-1 Apparatus Body 2

The apparatus body 2 includes an aperture 5, a cover 6, a sheet-discharge tray 35, and a sheet tray 36.

When the process cartridge 3 is mounted on the apparatus body 2, the aperture 5 is positioned opposite to the fixing device 33 with respect to the process cartridge 3 in the attachment/detachment direction A. The process cartridge 3 is detachably mountable in the apparatus body 2 in the attachment/detachment direction A through the aperture 5.

Figure 11:
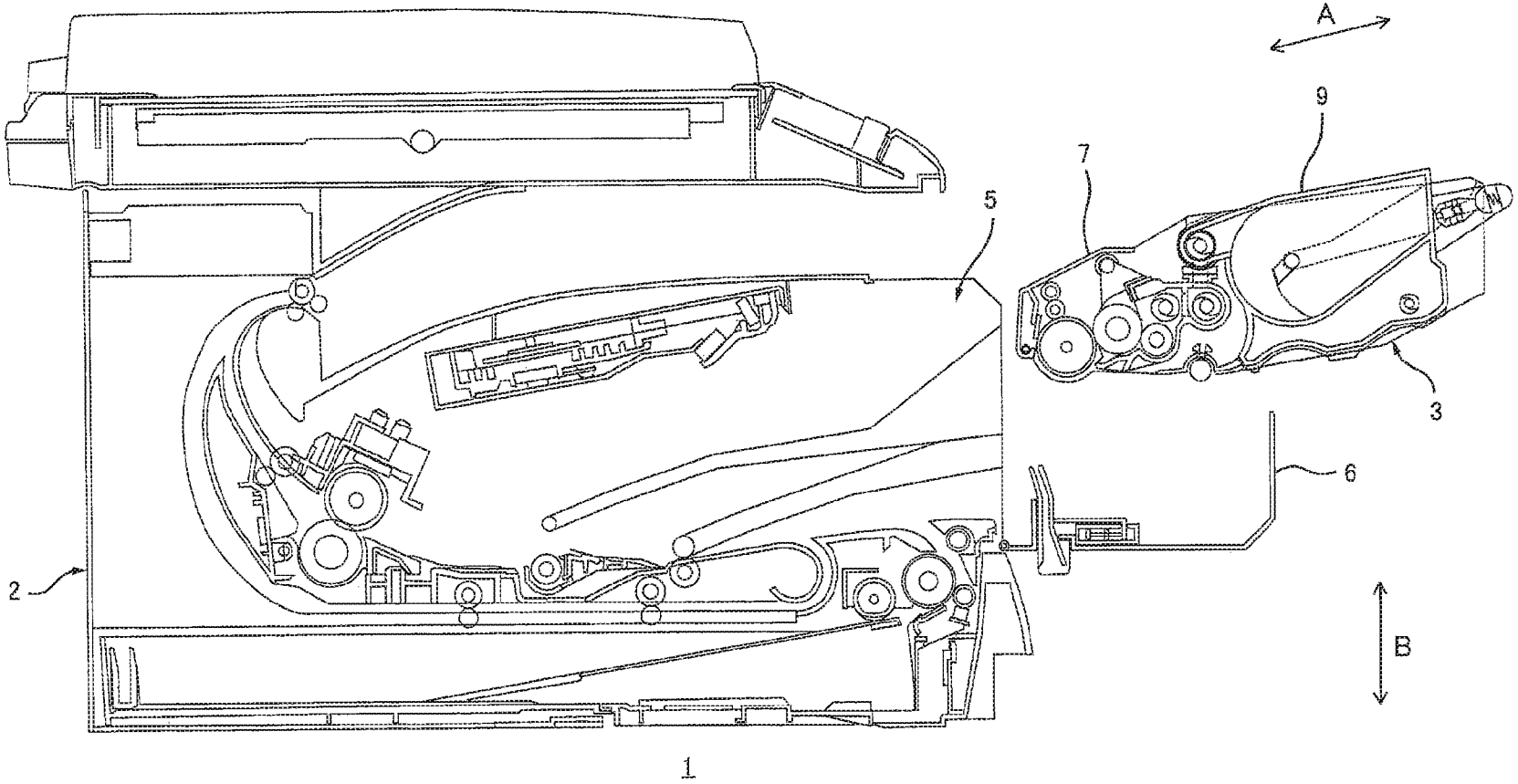
FIG. 11 is an explanatory view illustrating attachment/detachment of the process cartridge relative to an apparatus body of the image-forming apparatus in the first embodiment.

The cover 6 is movable between a closed position (see FIG. 1) and an open position (see FIG. 11). At the closed position, the cover 6 closes the aperture 5. At the open position, the cover 6 opens the aperture 5.

The sheet-discharge tray 35 is provided to be aligned with the mounted process cartridge 3 in the crossing direction B. That is, the sheet-discharge tray 35 is positioned above the process cartridge 3 mounted in the apparatus body 2. Image-formed sheets P are configured to be discharged onto the sheet-discharge tray 35.

The sheet tray 36 is positioned opposite to the sheet-discharge tray 35 with respect to the mounted process cartridge 3 in the crossing direction B. That is, the sheet tray 36 is positioned below the mounted process cartridge 3. The sheet tray 36 can accommodate the sheets P therein.

1-2. Process Cartridge 3

The process cartridge 3 can be mounted in and detached from the apparatus body 2 through the aperture 5. The process cartridge 3 includes a drum cartridge 7 and a toner cartridge 9.

1-2-1. Drum Cartridge 7

The drum cartridge 7 includes a photosensitive drum 17, a drum frame 12, and a developing device 13.

The photosensitive drum 17 is configured to rotate about a rotational axis X shown in FIG. 1. The rotational axis X of the photosensitive drum 17 extends in an axial direction C that is indicated by an arrow C in the drawings. In the present embodiment, the axial direction C generally coincides with a left-right direction.

The drum frame 12 supports the photosensitive drum 17.

The developing device 13 is pivotably supported by the drum frame 12. The developing device 13 is configured to receive toner therein. The developing device 13 includes a developing roller 25.

The developing roller 25 is configured to supply toner, which is stored in the developing device 13, to the photosensitive drum 17. The developing roller 25 extends in the axial direction C of the photosensitive drum 17. The developing roller 25 includes a shaft 25A and a roller body 25B. The shaft 25A has a columnar shape. The roller body 25B is provided on and around the shaft 25A. The roller body 25B has a peripheral surface configured to carry toner thereon. The roller body 25B is rotatable together with the shaft 25A. A part of the roller body 25B is exposed from the drum frame 12 of the developing device 13. The roller body 25B of the developing roller 25 is configured to make contact with the photosensitive drum 17.

1-2-2. Toner Cartridge 9

The toner cartridge 9 is attachable to and detachable from the drum frame 12. The toner cartridge 9 is positioned opposite to the fixing device 33 with respect to the photosensitive drum 17 in the attachment/detachment direction A, when the process cartridge 3 is mounted on the apparatus body 2. Incidentally, in the present embodiment, a direction in which the toner cartridge 9 is attached to the drum cartridge 7 (and a direction in which the toner cartridge 9 is detached from the drum cartridge 7) generally coincides with the attachment/detachment direction A in which the process cartridge 3 is mounted and removed relative to the apparatus body 2 through the aperture 5. Accordingly, hereinafter, the direction in which the toner cartridge 9 is attached/detached relative to the drum cartridge 7 will also be collectively referred to as the attachment/detachment direction A.

The toner cartridge 9 includes a toner container 28 and a waste toner container 29.

The toner container 28 stores toner to be supplied to the developing roller 25. That is, the toner stored in the toner container 28 is configured to be supplied to the developing device 13. The toner container 28 extends in a direction away from the photosensitive drum 17 with respect to the developing roller 25 in the attachment/detachment direction A.

The waste toner container 29 is aligned with the toner container 28 in the crossing direction B. Preferably, as in the present embodiment, the waste toner container 29 is positioned below the toner container 28. The waste toner container 29 is formed integrally with the toner container 28. The waste toner container 29 is configured to stores waste toner that is removed from the photosensitive drum 17.

1-3. Transfer Roller 18

The transfer roller 18 is configured to contact the photosensitive drum 17 when the process cartridge 3 is mounted in the apparatus body 2. The transfer roller 18 is configured to transfer a toner image carried on the photosensitive drum 17 onto each sheet P.

1-4. Fixing Device 33

The fixing device 33 is positioned opposite to the cover 6 with respect to the process cartridge in the attachment/detachment direction A when the process cartridge 3 is mounted in the apparatus body 2. The fixing device 33 is configured to fix the toner image, which has been transferred to the sheet P, to the sheet P.

2. Toner Cartridge 9

2-1. Toner Container 28

Figure 2A:
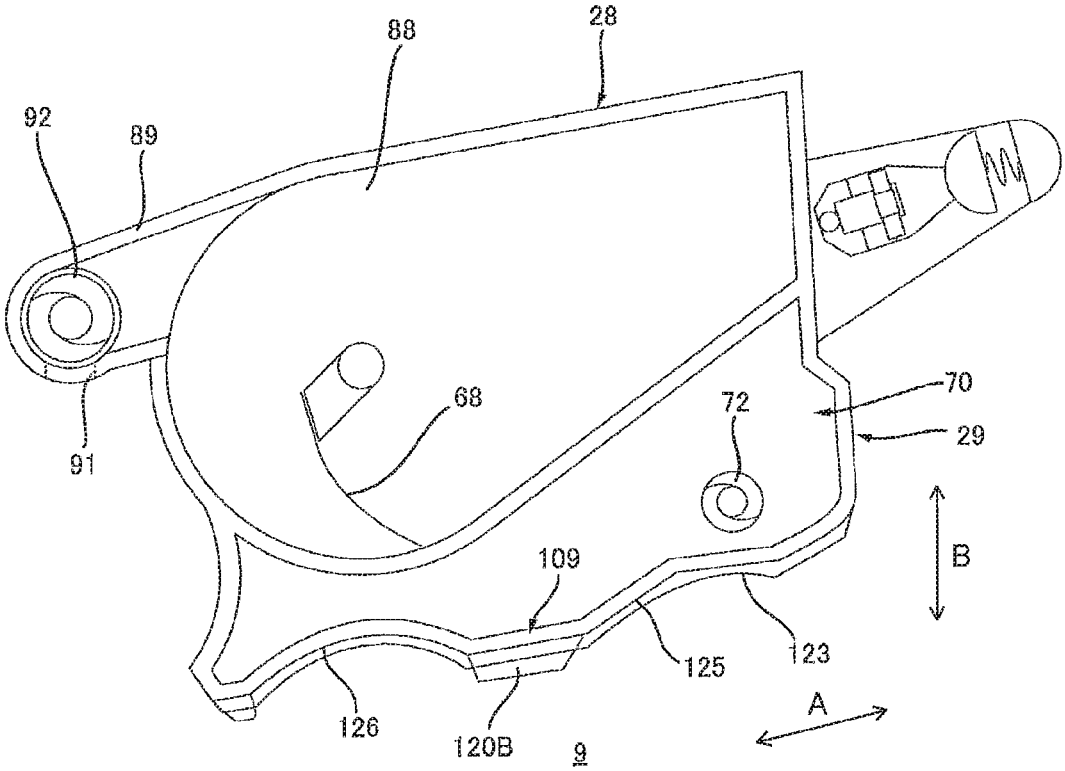
FIG. 2A is a central cross-sectional view of a toner cartridge constituting the process cartridge according to the first embodiment shown in FIG. 1.
Figure 2B:
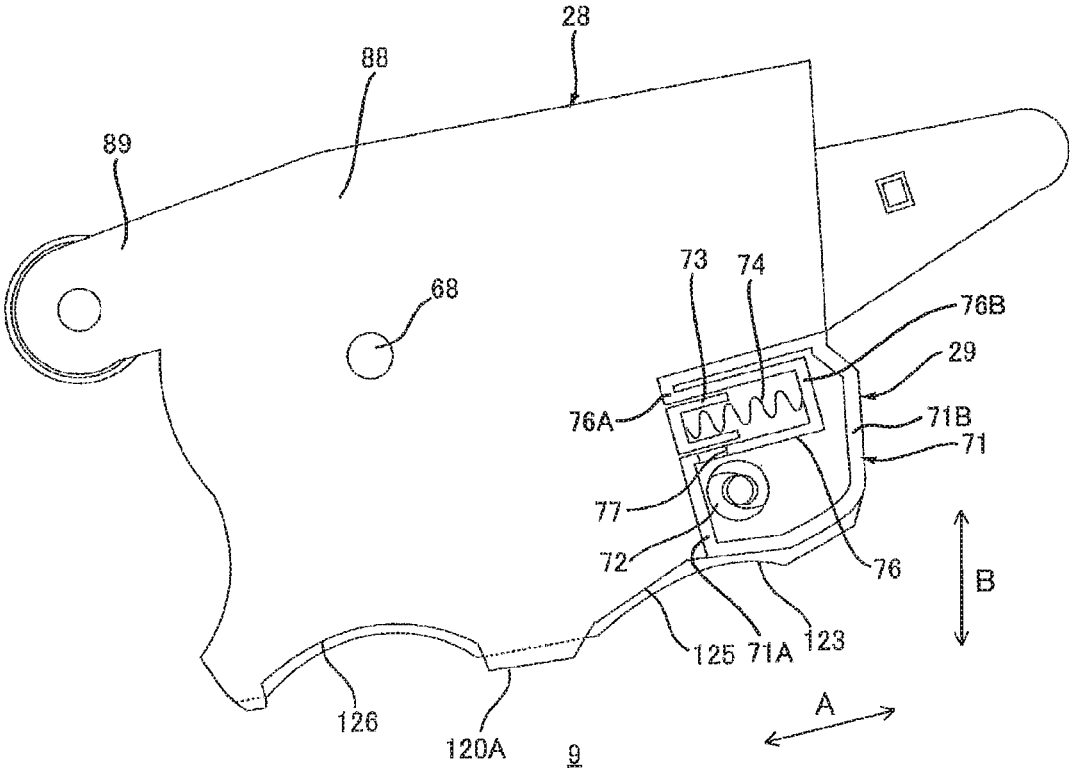
FIG. 2B is a cross-sectional side view of the toner cartridge according to the first embodiment.

The toner container 28 stores toner to be supplied to the developing roller 25. As illustrated in FIGS. 2A and 2B, the toner container 28 includes a storage portion 88, a conveying portion 89, an agitator 68, and an auger screw 92.

2-1-1. Storage Portion 88

The storage portion 88 stores toner therein. The storage portion 88 extends in the axial direction C. The storage portion 88 is generally hollow cylindrical shaped (see FIG. 3).

2-1-2. Conveying Portion 89

Figure 3:
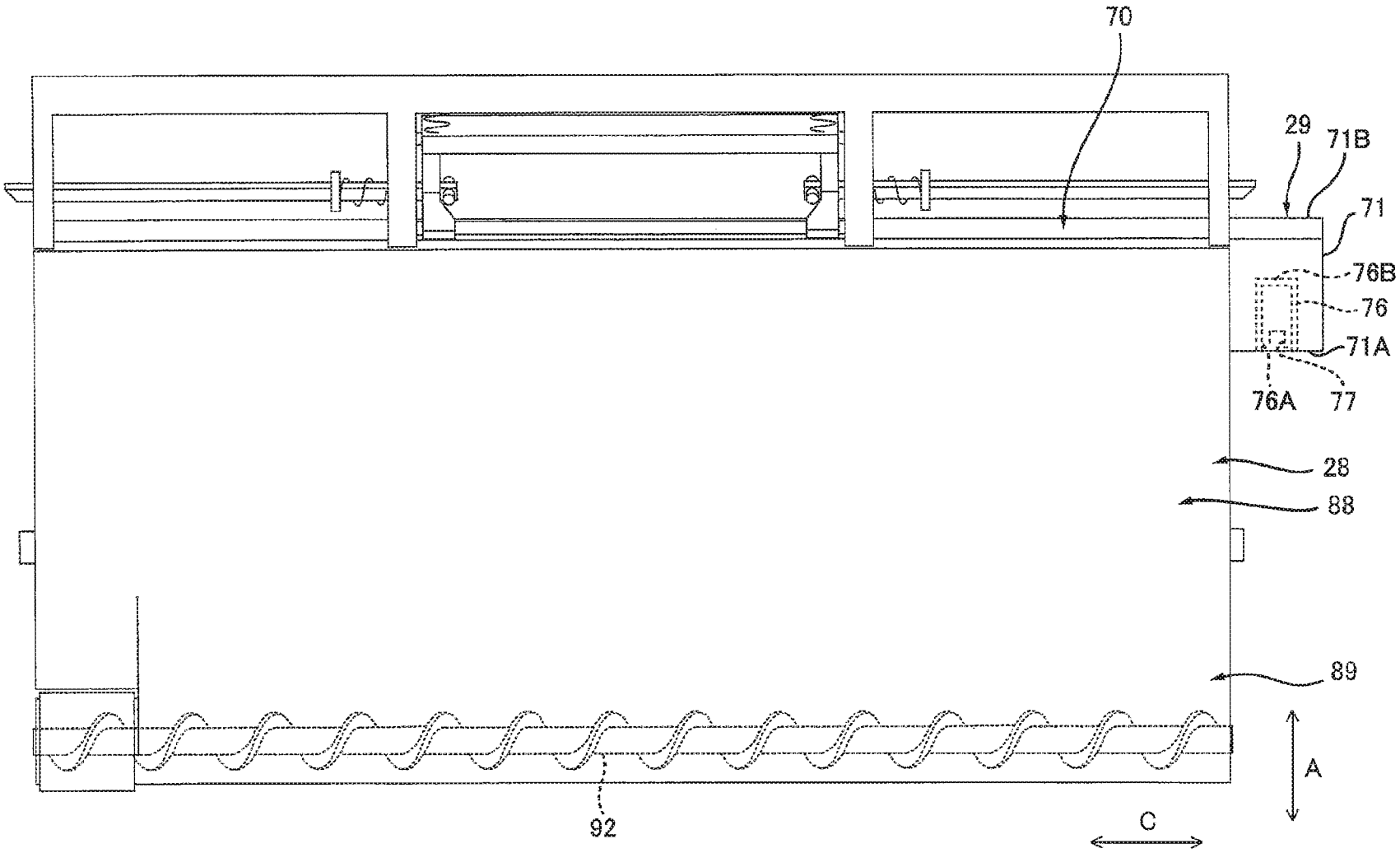
FIG. 3 is a plan view of the toner cartridge according to the first embodiment.

As illustrated in FIG. 1, when the toner cartridge 9 is attached to the drum cartridge 7, the conveying portion 89 extends toward the developing device 13 from the storage portion 88 in the attachment/detachment direction A. As illustrated in FIGS. 2A and 3, the conveying portion 89 extends in the axial direction C. The conveying portion 89 is communication with the storage portion 88. The conveying portion 89 includes a supply port 91.

Specifically, the supply port 91 is formed to penetrate through a peripheral wall constituting the conveying portion 89. In the embodiment, the supply port 91 penetrates through a lower end portion of the peripheral wall of the conveying portion 89.

2-1-3. Agitator 68 and Auger Screw 92

As illustrated in FIG. 2A, the agitator 68 is disposed inside the storage portion 88. The agitator 68 is configured to agitate toner stored in the storage portion 88. The agitator 68 is configured to convey the toner stored in the storage portion 88 toward the conveying portion 89.

As illustrated in FIGS. 2A and 3, the auger screw 92 is disposed in the conveying portion 89. The auger screw 92 extends in the axial direction C. The auger screw 92 is configured to convey the toner, which is supplied to the conveying portion 89 from the storage portion 88, toward the supply port 91.

2-2. Waste Toner Container 29

The waste toner container 29 is configured to store waste toner that was removed from the photosensitive drum 17 and conveyed by a conveying pipe 22 (described later). As illustrated in FIG. 1, the waste toner container 29 is disposed opposite to the photosensitive drum 17 with respect to the developing roller 25 in the attachment/detachment direction A when the waste toner container 29 (toner cartridge 9) is mounted on the drum frame 12. The waste toner container 29 is aligned with the toner container 28 in the crossing direction B. Preferably, as in the embodiment, the waste toner container 29 is positioned below the toner container 28. The waste toner container 29 is integrally formed with the toner container 28. Accordingly, the waste toner container 29 can be mounted on and removed from the drum frame 12 together with the toner container 28.

The waste toner container 29 has a capacity that is not less than 5% of a capacity of the toner container 28 but not more than 50% thereof, for example. Preferably, the capacity of the waste toner container 29 is not less than 10% of the capacity of the toner container 28 but not more than 30% thereof. Accordingly, an upper limit of the capacity of the waste toner container 29 can be roughly estimated, based on the capacity of the toner container 28.

As illustrated in FIGS. 2A and 2B, the waste toner container 29 includes a body portion 70, a protruding portion 71, an auger screw 72, a shutter 73, and a spring 74.

2-2-1. Body Portion 70

The body portion 70 is configured to store waste toner that is removed from the photosensitive drum 17. The body portion 70 is overlapped with the toner container 28 in the crossing direction B. As will be described later in detail, the body portion 70 constitutes part of a sheet-conveying guide 105 for guiding conveyance of the sheets P toward the photosensitive drum 17. That is, when the process cartridge 3 (with the waste toner container 29 mounted on the drum frame 12) is mounted in the apparatus body 2, the waste toner container 29 constitutes a part of the sheet-conveying guide 105.

2-2-2. Protruding Portion 71

As shown in FIG. 3, the protruding portion 71 is provided at an end portion of the body portion 70 in the attachment/detachment direction A (i.e., front end portion of the body portion 70. This end portion (front end portion) of the body portion 70 is positioned farther away from the conveying portion 89 than another end (rear end) of the body portion 70 near the conveying portion 89 in the attachment/detachment direction A. As illustrated in FIGS. 2B and 3, the protruding portion 71 protrudes in the axial direction C relative to the body portion 70. The protruding portion 71 is in communication with the body portion 70. The protruding portion 71 includes a first end wall 71A and a second end wall 71B opposite to the first end wall 71A in the attachment/detachment direction A. The first end wall 71A is positioned closer to the conveying portion 89 than the second end wall 71B is to the conveying portion 89 in the attachment/detachment direction A. The protruding portion 71 includes a receiving cylinder 76.

The receiving cylinder 76 extends toward the second end wall 71B from the first end wall 71A in the attachment/detachment direction A. The receiving cylinder 76 has a cylindrical shape. The receiving cylinder 76 has one end portion 76A and another end portion 76B opposite to the one end portion 76A in the attachment/detachment direction A. The one end portion 76A of the receiving cylinder 76 is opened. The other end portion 76B of the receiving cylinder 76 is closed. The receiving cylinder 76 includes a receiving port 77.

The receiving port 77 is a port for receiving waste toner therethrough into the waste toner container 29. As illustrated in FIG. 2B, the receiving port 77 is provided in a peripheral wall constituting the receiving cylinder 76, the peripheral wall being positioned opposite the toner container 28 with respect to the shutter 73 in the crossing direction B. The receiving port 77 penetrates through the peripheral wall of the receiving cylinder 76. Preferably, as in the present embodiment, the receiving port 77 is provided to penetrate through a lower end portion of the peripheral wall constituting the receiving cylinder 76.

2-2-3. Auger Screw 72

As illustrated in FIGS. 2A and 2B, the auger screw 72 is positioned in the body portion 70 and the protruding portion 71. The auger screw 72 extends in the axial direction C. Specifically, the auger screw 72 has one end (right end) and another end (left end) in the axial direction C. The one end of the auger screw 72 is rotatably supported by the body portion 70, and the other end of the auger screw 72 is rotatably supported by the protruding portion 71. The other end (left end) of the auger screw 72 faces the receiving port 77 in the crossing direction B. The auger screw 72 is configured to convey waste toner, which has flowed into the protruding portion 71 through the receiving port 77, toward the body portion 70 from the protruding portion 71.

2-2-4. Shutter 73 and Spring 74

As illustrated in FIG. 2B, the shutter 73 is disposed within the receiving cylinder 76. The shutter 73 is movable in the attachment/detachment direction A between a closed position (see FIG. 2B) and an open position (see FIG. 8). At the closed position, the shutter 73 closes the receiving port 77. At the open position, the shutter 73 opens the receiving port 77.

The spring 74 is provided between the shutter 73 and the other end portion 76B of the receiving cylinder 76, more specifically, between the shutter 73 and an inner surface of the other end portion 76B of the receiving cylinder 76. The spring 74 urges the shutter 73 such that the shutter 73 is always at the closed position.

3. Detailed Structure of Drum Cartridge 7

3-1. Structure of Drum Frame 12

Figure 4:
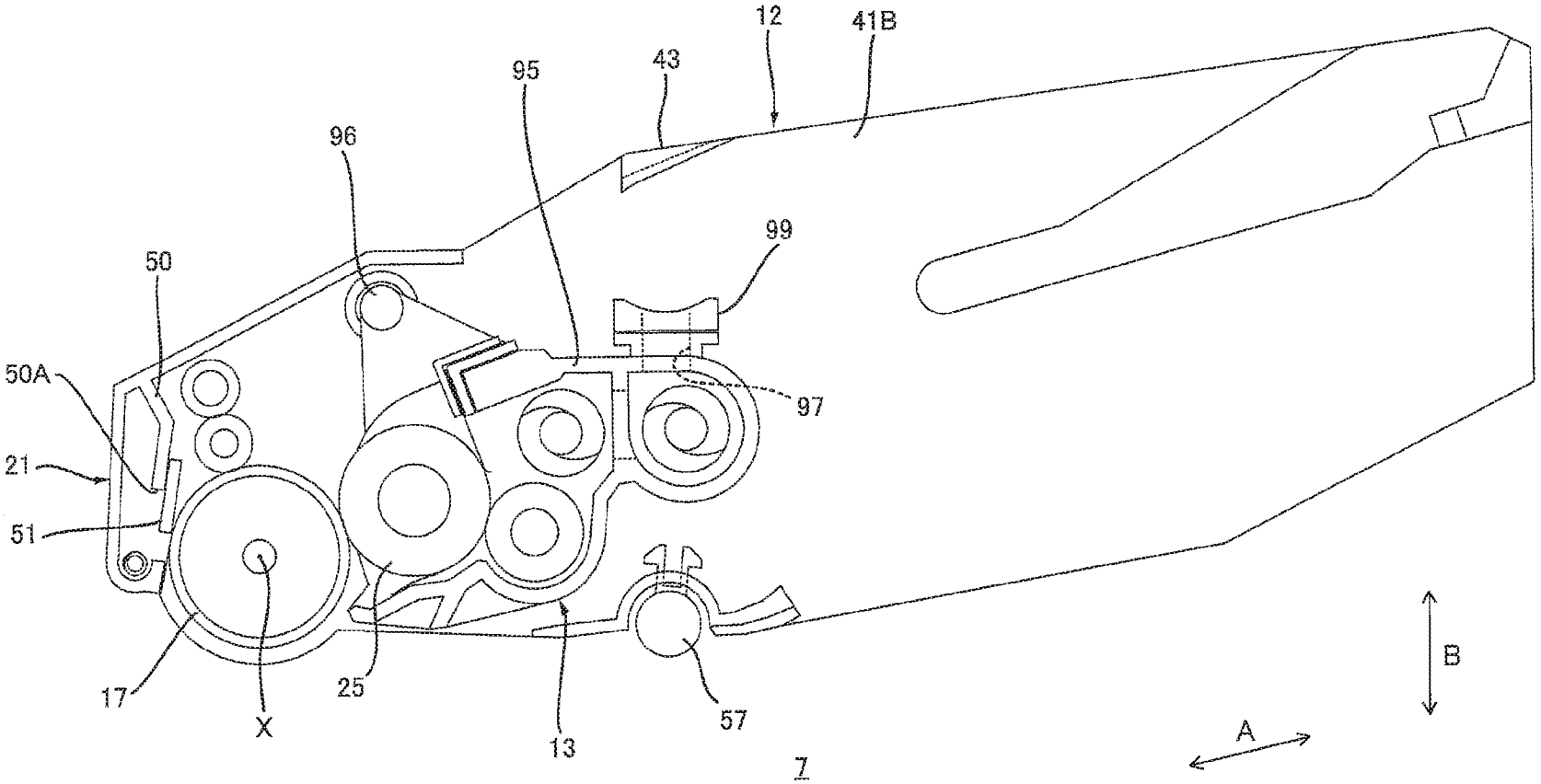
FIG. 4 is a central cross-sectional view of a drum cartridge constituting the process cartridge according to the first embodiment shown in FIG. 1.
Figure 5:
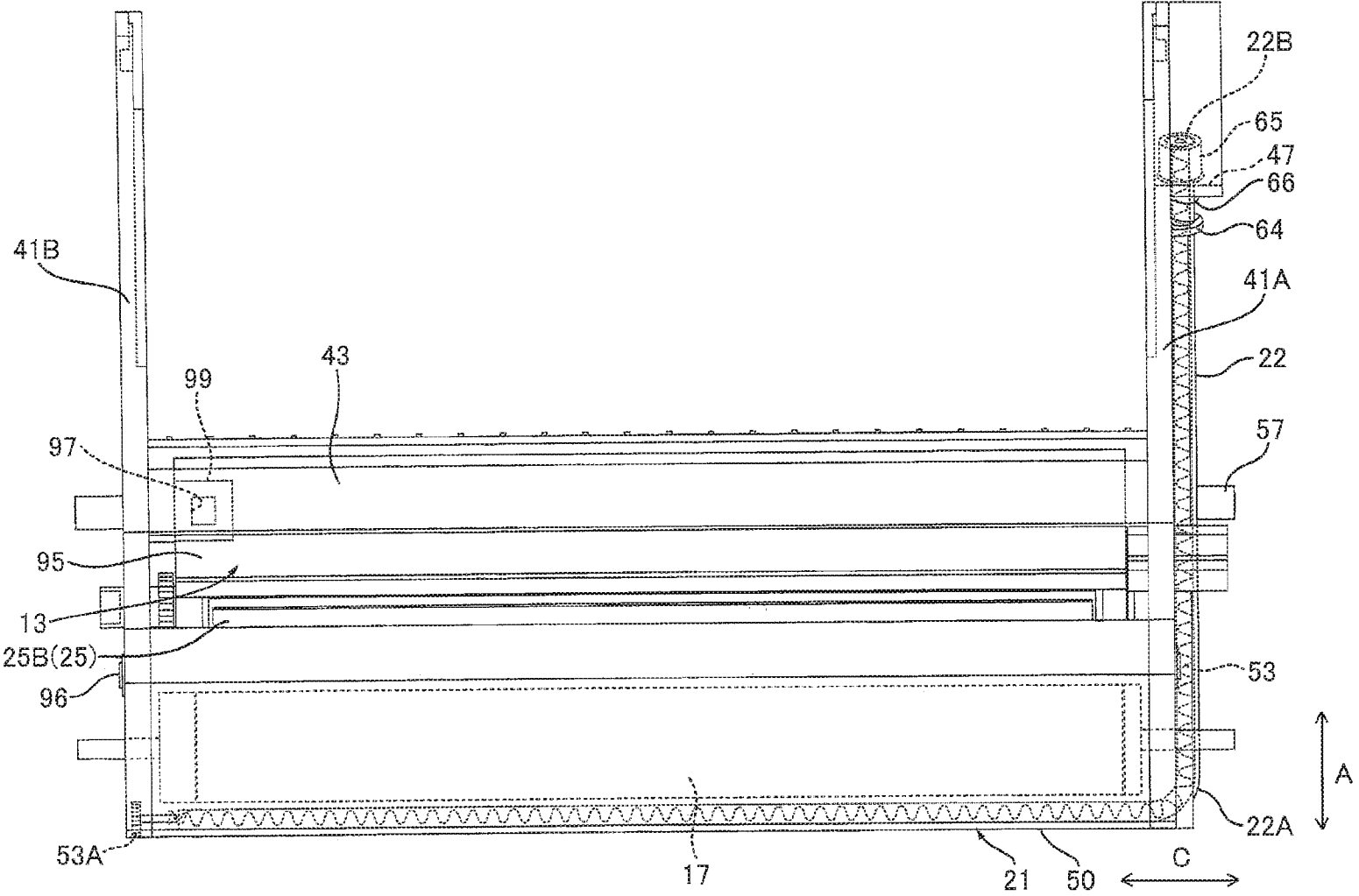
FIG. 5 is a plan view of the drum cartridge according to the first embodiment.

Referring to FIGS. 4 and 5, the drum frame 12 includes a side wall 41A, a side wall 41B, a connecting wall 43, and a conveyer roller 57.

The side walls 41A and 41B are positioned to be spaced apart from each other in the axial direction C. The side walls 41A and 41B extend in the attachment/detachment direction A. The side walls 41A and 41B have a plate-like shape. The side wall 41A supports one end of the photosensitive drum 17 in the axial direction C. The side wall 41B supports another end of the photosensitive drum 17 in the axial direction C.

Figure 6:
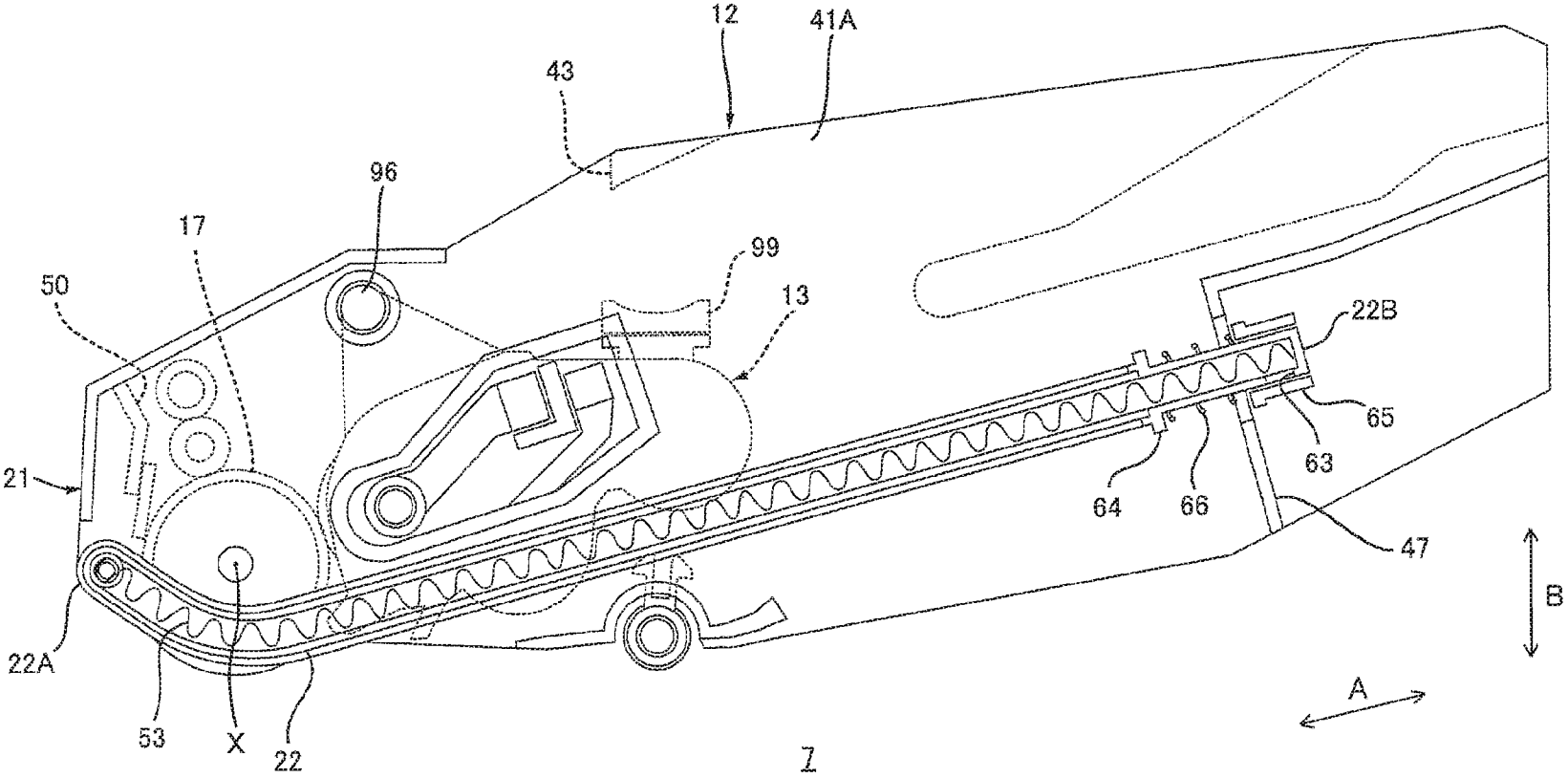
FIG. 6 is a cross-sectional side view of the drum cartridge according to the first embodiment.
Figure 9:
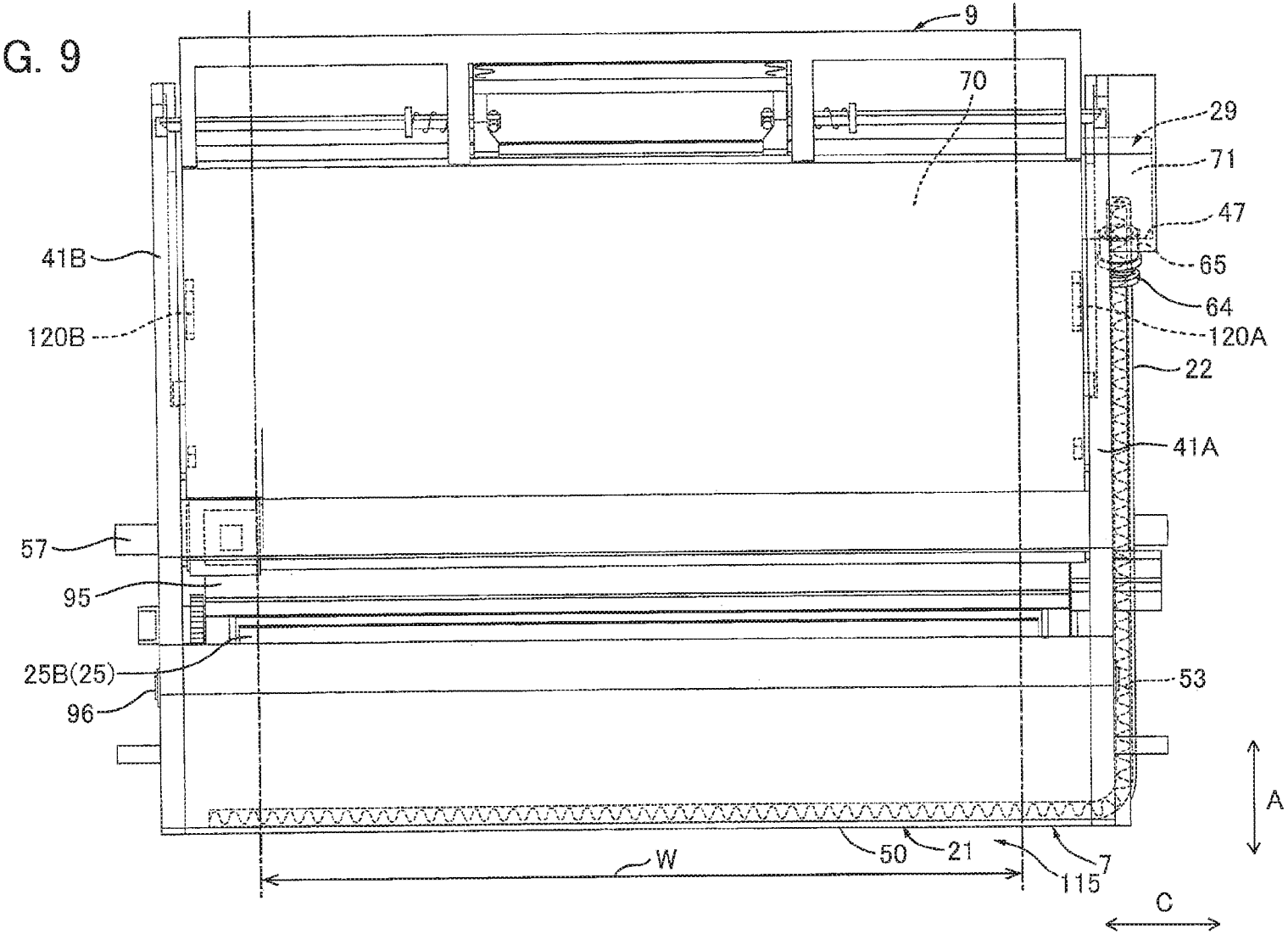
FIG. 9 is a plan view of the process cartridge according to the first embodiment shown in FIG. 7.

As illustrated in FIGS. 5, 6 and 9, the side wall 41A includes a cutout portion 47. Specifically, referring to FIG. 6, the side wall 41A has an end portion positioned opposite to a cleaner 21 (described later) with respect to the photosensitive drum 17 in the attachment/detachment direction A. The end portion of the side wall 41A has a larger width than a remaining portion of the side wall 41A in the axial direction C. The cutout portion 47 is provided in this end portion of the side wall 41A. That is, the cutout portion 47 is positioned opposite to the cleaner 21 with respect to the photosensitive drum 17 in the attachment/detachment direction A.

Specifically, the cutout portion 47 is provided by cutting out a portion of the end portion of the side wall 41A toward the photosensitive drum 17. The cutout portion 47 extends in the attachment/detachment direction A. The cutout portion 47 provides a space for receiving the protruding portion 71 of the toner cartridge 9 when the toner cartridge 9 is attached to the drum cartridge 7.

As illustrated in FIGS. 4 and 5, the connecting wall 43 is positioned between the side wall 41A and side wall 41B to span therebetween. Preferably, as in the embodiment, the connecting wall 43 constitutes an upper end portion of the drum frame 12. The connecting wall 43 is positioned at a position substantially center of the drum frame 12 in the attachment/detachment direction A.

As illustrated in FIG. 1, when the process cartridge 3 is mounted in the apparatus body 2, the conveyer roller 57 is positioned to face a roller provided in the apparatus body 2 so that each sheet P passes between the conveyer roller 57 and the roller to be conveyed toward a position between the photosensitive drum 17 and the transfer roller 18. The conveyer roller 57 is positioned opposite to the fixing device 33 with respect to the photosensitive drum 17 in the attachment/detachment direction A, when the process cartridge 3 is mounted in the apparatus body 2. As illustrated in FIGS. 4 and 5, the conveyer roller 57 extends in the axial direction C. Preferably, as in the present embodiment, the conveyer roller 57 is positioned at a lower end portion of the drum frame 12. The conveyer roller 57 is disposed at a position substantially center of the drum frame 12 in the attachment/detachment direction A.

3-2. Structure of Developing Device 13

As illustrated in FIG. 4, the developing device 13 is positioned opposite to the cleaner 21 with respect to the photosensitive drum 17 in the attachment/detachment direction A. In the crossing direction B, the developing device 13 is positioned between the connecting wall 43 and the conveyer roller 57. The developing device 13 includes a developing frame 95 and a shaft 96.

The developing frame 95 has a substantially box-like shape. The developing frame 95 supports the developing roller 25. The developing frame 95 includes a communication port 97.

Figure 7:
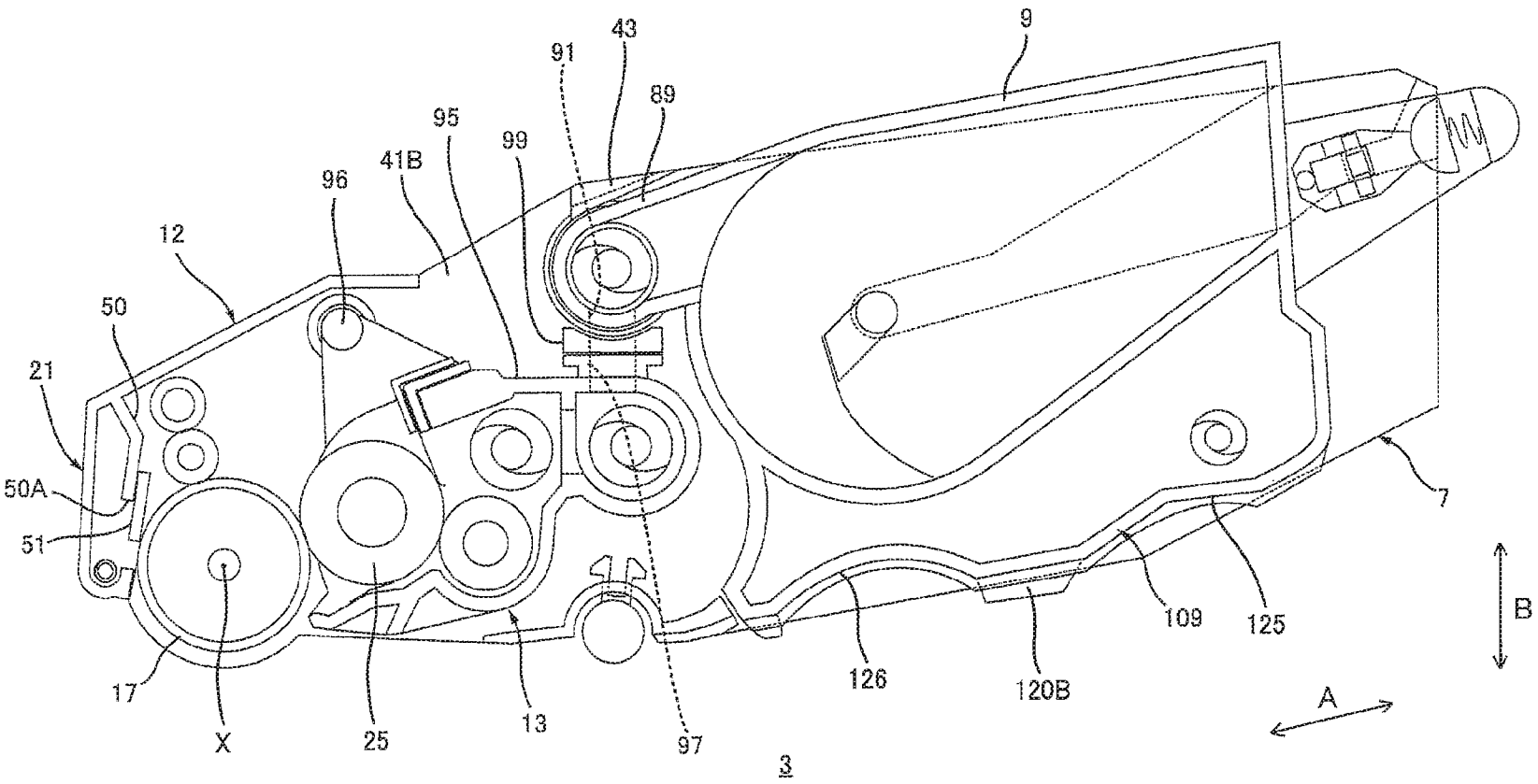
FIG. 7 is a central cross-sectional view of the process cartridge according to the first embodiment.

In the developing frame 95, the communication port 97 is positioned opposite to the photosensitive drum 17 with respect to the developing roller 25. The communication port 97 penetrates through a portion of the developing frame 95, specifically, an upper portion of the developing frame 95, in the crossing direction B. As illustrated in FIG. 7, when the toner cartridge 9 is mounted on the drum cartridge 7, the communication port 97 can communicate with the supply port 91 of the conveying portion 89 in the crossing direction B via a sealing member 99.

The sealing member 99 is provided to suppress leakage of toner from between the conveying portion 89 and the developing frame 95. A hole is formed in a center portion of the sealing member 99 to penetrate the same in the crossing direction B (also see FIGS. 5 and 7).

As illustrated in FIGS. 4 and 5, the shaft 96 is provided between the photosensitive drum 17 and the sealing member 99 in the attachment/detachment direction A. Preferably, as in the present embodiment, the shaft 96 is positioned above the developing roller 25. The shaft 96 is provided at the developing frame 95 to penetrate therethrough in the axial direction C. The shaft 96 has one end rotatably supported by the side wall 41A constituting the drum frame 12, and another end rotatably supported by the side wall 41B constituting the drum frame 12.

Accordingly, the developing device 13 is pivotable about the shaft 96 relative to the drum frame 12.

4. Structure for Conveying Waste Toner in Drum Cartridge 7

4-1. Cleaner 21

As illustrated in FIGS. 4 and 5, the drum cartridge 7 further includes the cleaner 21.

The cleaner 21 is configured to remove toner from a peripheral surface of the photosensitive drum 17. The cleaner 21 is positioned opposite to the developing device 13 with respect to the photosensitive drum 17 in the attachment/detachment direction A. The cleaner 21 includes a cleaning frame 50 and a cleaning member 51.

The cleaning frame 50 extends in the axial direction C. The cleaning frame 50 has a generally cylindrical shape defining an inner space therein. The cleaning frame 50 has one end in the axial direction C that is connected to the side wall 41A. Another end of the cleaning frame 50 in the axial direction C is connected to the side wall 41B. As illustrated in FIG. 4, the cleaning frame 50 is formed with an opening 50A.

The opening 50A is formed in a portion of the cleaning frame 50, the portion facing the photosensitive drum 17. That is, the opening 50A faces the photosensitive drum 17. The cleaning frame 50 penetrates the portion of the cleaning frame 50 therethrough in the attachment/detachment direction A. The opening 50A extends in the axial direction C.

The cleaning member 51 is plate shaped. The cleaning member 51 is fixed to a periphery defining the opening 50A of the cleaning frame 50. The cleaning member 51 is in contact with the peripheral surface of the photosensitive drum 17. Specifically, the cleaning member 51 is in contact with the peripheral surface of the photosensitive drum 17 at a position downstream relative to a position of contact between the photosensitive drum 17 and the transfer roller 18 in a rotational direction of the photosensitive drum 17.

Further, in the cleaner 21, the cleaning member 51 is configured to scrape off toner that is left on the peripheral surface of the photosensitive drum 17 without being transferred to a sheet P from the peripheral surface of the photosensitive drum 17. The scraped toner (waste toner) is configured to be received into the cleaning frame 50 through the opening 50A and to be stored in the inner space of the cleaning frame 50. The toner stored in the cleaning frame 50 is then conveyed to the waste toner container 29 of the toner cartridge 9 through the conveying pipe 22 in accordance with rotation of a conveying member 53 (described later) disposed within the conveying pipe 22.

4-2. Conveying Pipe 22, Conveying Member 53, Shutter 65, and Spring 66

As illustrated in FIGS. 5 and 6, the drum cartridge 7 further includes the conveying pipe 22, the conveying member 53, a shutter 65, and a spring 66.

4-2-1. Conveying Pipe 22

Figure 8:
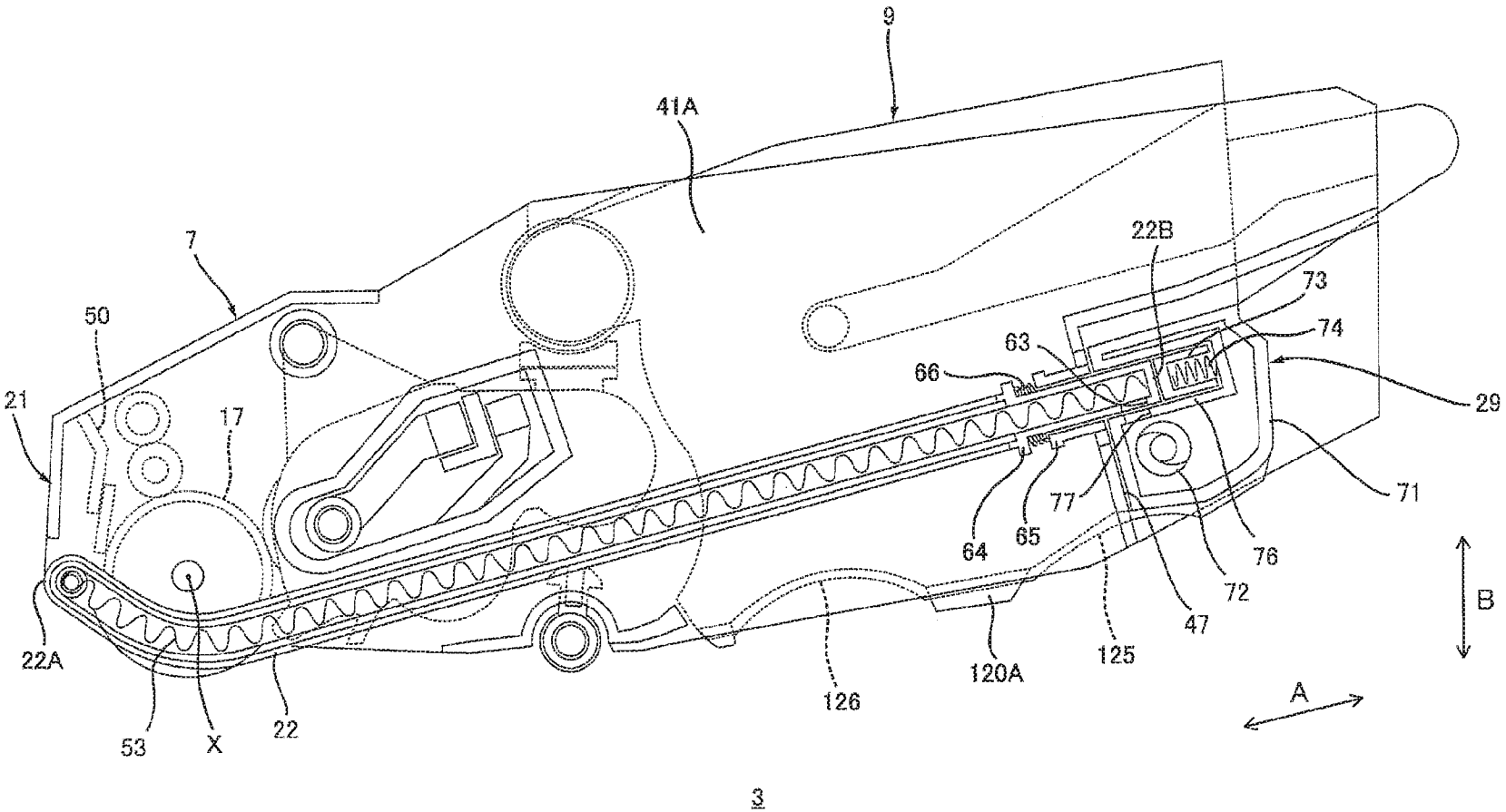
FIG. 8 is a cross-sectional side view of the process cartridge according to the first embodiment shown in FIG. 7.

The conveying pipe 22 is configured to transport the waste toner removed by the cleaner 21. As illustrated in FIGS. 8 and 9, the conveying pipe 22 is adapted to connect the cleaning frame 50 of the cleaner 21 to the waste toner container 29 of the toner cartridge 9 when the toner cartridge 9 is mounted on the drum cartridge 7. The waste toner, which was removed from the peripheral surface of the photosensitive drum 17, is configured to be conveyed through the conveying pipe 22. The conveying pipe 22 extends in the attachment/detachment direction A of the toner cartridge 9 relative to the drum cartridge 7. As illustrated in FIGS. 5 and 6, the conveying pipe 22 is positioned opposite to the side wall 41B with respect to the side wall 41A in the axial direction C. The conveying pipe 22 has a cylindrical shape. The conveying pipe 22 includes a first end portion 22A and a second end portion 22B. The conveying pipe 22 further includes an annular portion 64 and a discharge port 63.

The first end portion 22A is an end portion of the conveying pipe 22 that is positioned close to the photosensitive drum 17 in the attachment/detachment direction A. The first end portion 22A overlaps the cleaner 21 in the axial direction C. The first end portion 22A is connected to the side wall 41A. The first end portion 22A is in communication with the inner space of the cleaning frame 50.

The second end portion 22B is an end portion of the conveying pipe 22 opposite to the first end portion 22A in the attachment/detachment direction A. The second end portion 22B extends up to the cutout portion 47.

The annular portion 64 is arranged closer to the photosensitive drum 17 than the cutout portion 47 is to the photosensitive drum 17. The annular portion 64 protrudes from a peripheral surface of the conveying pipe 22 to extend radially outward therefrom. That is, the annular portion 64 has an annular shape.

The discharge port 63 is positioned farther away from the photosensitive drum 17 than the annular portion 64 is from the photosensitive drum 17. The discharge port 63 penetrates through a peripheral wall constituting the conveying pipe 22. Preferably, as in the embodiment, the discharge port 63 penetrates through a lower end portion of the peripheral wall of the conveying pipe 22. The discharge port 63 is configured to discharge waste toner therethrough.

As illustrated in FIG. 8, when the toner cartridge 9 is mounted on the drum cartridge 7, the second end portion 22B of the conveying pipe 22 is fitted in the receiving cylinder 76 of the protruding portion 71 in attachment/detachment direction A. Accordingly, the conveying pipe 22 is connected to the protruding portion 71 of the waste toner container 29. At this time, the discharge port 63 of the conveying pipe 22 and the receiving port 77 of the receiving cylinder 76 face each other and are in communication with each other.

4-2-2. Conveying Member 53

As illustrated in FIGS. 5 and 6, the conveying member 53 is provided in the cleaning frame 50, and in the conveying pipe 22. The conveying member 53 thus extends in the axial direction C and in the attachment/detachment direction A. The conveying member 53 has a spiral shape. The conveying member 53 has one end portion that is rotatably supported by the side wall 41B of the cleaning frame 50 via a conveyor gear 53A. Another end portion of the conveying member 53, which is opposite to the one end portion thereof, is rotatably supported by the second end portion 22B of the conveying pipe 22. The other end portion of the conveying member 53 faces the discharge port 63 of the conveying pipe 22.

The conveying member 53 is configured to rotate upon receipt of a drive force at the conveyor gear 53A from a drive source (not shown) of the image-forming apparatus 1. As the conveying member 53 rotates, the conveying member 53 is configured to convey the waste toner within the cleaning frame 50 and the conveying pipe 22 toward the waste toner container 29.

4-2-3. Shutter 65 and Spring 66

The shutter 65 is provided to cover an outer peripheral surface of the second end portion 22B of the conveying pipe 22. The shutter 65 has a cylindrical shape. The shutter 65 is movable along the conveying pipe 22 between a closing position (see FIG. 6) and an open position (see FIG. 8) closer to the annular portion 64 than the closing position is to the annular portion 64. The shutter 65 at the closing position closes the discharge port 63. At the open position, the shutter 65 opens the discharge port 63.

The spring 66 is positioned between the shutter 65 and the annular portion 64. The spring 66 has one end in contact with the shutter 65, and another end in contact with the annular portion 64. The spring 66 normally urges the shutter 65 toward the closed position.

5. Attachment/Detachment of Toner Cartridge 9 to/from Drum Cartridge 7

Next, the attachment/detachment of the toner cartridge 9 relative to the drum cartridge 7 will be described with reference to FIGS. 7 to 9.

For attaching the toner cartridge 9 to the drum cartridge 7, a user pushes the toner cartridge 9 into the drum cartridge 7.

Accordingly, as illustrated in FIG. 7, the conveying portion 89 of the toner cartridge 9 is fitted between the sealing member 99 and the connecting wall 43. The supply port 91 of the conveying portion 89 and the communication port 97 of the developing device 13 face each other, thereby being in communication with each other.

Further, as illustrated in FIG. 8, the protruding portion 71 of the waste toner container 29 of the toner cartridge 9 is fitted to the cutout portion 47 of the drum cartridge 7.

The second end portion 22B of the conveying pipe 22 is received in the receiving cylinder 76 of the protruding portion 71.

At this time, the shutter 73 of the toner cartridge 9 is in contact with the second end portion 22B of the conveying pipe 22 and the shutter 65 of the drum cartridge 7 is in contact with the protruding portion 71. When the toner cartridge 9 is further pressed, the shutter 73 is moved to its open position against an urging force of the spring 74. Further, the shutter 65 is moved to its open position against an urging force of the spring 66.

As a result, the discharge port 63 of the conveying pipe 22 and the receiving port 77 of the receiving cylinder 76 face each other, thereby being allowed to communicate with each other.

Attachment of the toner cartridge 9 to the drum cartridge 7 is thus complete.

Note that, when the toner cartridge 9 is mounted on the drum cartridge 7, as shown in FIG. 7, a first wall 109 (bottom wall) of the waste toner container 29 of the toner cartridge 9 is exposed from the drum frame 12. Specifically, the first wall 109 is exposed through a gap between the side wall 41A and the side wall 41B.

Incidentally, for detaching the toner cartridge 9 from the drum cartridge 7, the user may perform the above-described operations in reverse.

Next, as illustrated in FIG. 11, the user may mount the process cartridge 3 (the drum cartridge 7 to which the toner cartridge 9 is attached) on the apparatus body 2.

For mounting the process cartridge 3 in the apparatus body 2, the user first moves the cover 6 to the open position to open the aperture 5.

Next, the user inserts the process cartridge 3 in the apparatus body 2 through the aperture 5 to mount the process cartridge 3 in the apparatus body 2.

The user then moves the cover 6 to the closed position, as illustrated in FIG. 1.

The image-forming apparatus 1 is thus ready to perform image forming operations.

In order to remove the process cartridge 3 from the apparatus body 2, the user may perform the above-mentioned operations in reverse, as illustrated in FIG. 11.

Figure 12:
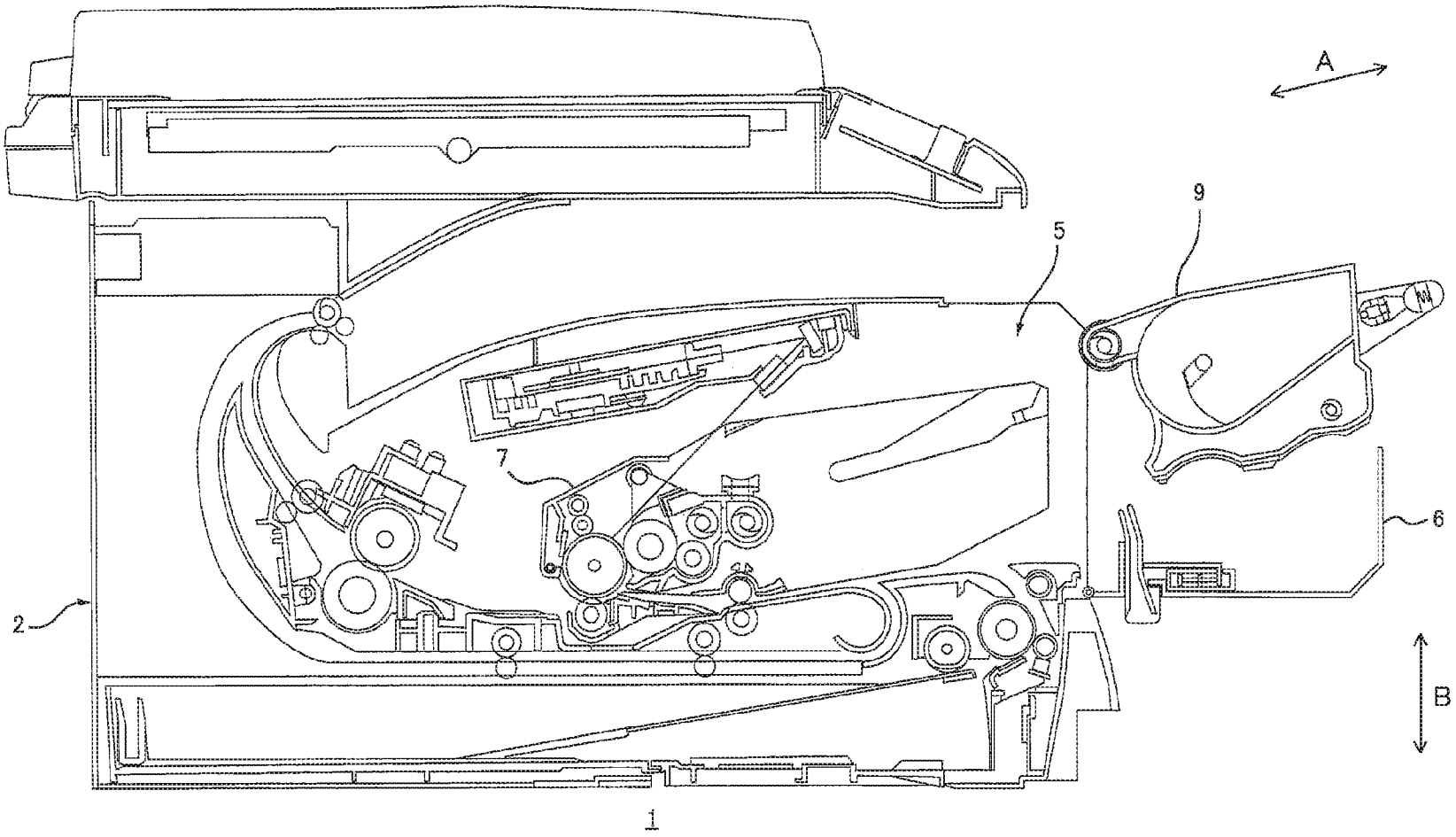
FIG. 12 is an explanatory view illustrating attachment/detachment of the toner cartridge relative to the drum cartridge in the first embodiment.

Note that, as illustrated in FIG. 12, the toner cartridge 9 can be independently mounted on and detached from the drum cartridge 7, even when the drum cartridge 7 is mounted on the apparatus body 2.

6. Removal of Waste Toner

Toner, which was not transferred to the sheets P during image formation, may remain adhered to the peripheral surface of the photosensitive drum 17.

Such toner (waste toner) deposited on the peripheral surface of the photosensitive drum 17 is scraped off by the cleaning member 51 of the cleaner 21 (see FIGS. 7 and 9), as the photosensitive drum 17 rotates. The scraped waste toner is stored in the cleaning frame 50.

Referring to FIGS. 8 and 9, the waste toner stored in the cleaning frame 50 is conveyed to the conveying pipe 22 from the cleaning frame 50, as the conveying member 53 is rotated. The waste toner conveyed to the conveying pipe 22 is then conveyed toward the waste toner container 29.

The waste toner conveyed through the conveying pipe 22 up to the second end portion 22B then flows into the protruding portion 71 through the discharge port 63 of the conveying pipe 22 and the receiving port 77 of the receiving cylinder 76.

The waste toner received in the protruding portion 71 is then conveyed to the body portion 70 by the auger screw 72, and is stored in the body portion 70.

Conveyance of waste toner is thus complete.

7. Structure for Conveying Sheets P

As illustrated in FIG. 1, the apparatus body 2 further includes a sheet-feed roller 104, a sheet-supply portion 140, a plurality of discharge rollers 135, and a reverse sheet-conveying guide 130. Further, the apparatus body 2 also includes a second wall 112 that constitutes a portion of the sheet conveying guide 105, together with the waste toner container 29 of the process cartridge 3 mounted in the apparatus body 2.

7-1. Sheet-Conveying Path 115

The sheet-feed roller 104 is disposed between the cover 6 and the sheet tray 36 in the crossing direction B. The sheet-feed roller 104 is configured to feed sheets P accommodated in the sheet tray 36 toward the photosensitive drum 17.

The sheet-conveying guide 105 extends up to the sheet-discharge tray 35 from a region between the sheet tray 36 and the process cartridge 3, when the process cartridge 3 (with waste toner container 29 mounted on the drum frame 12) is attached to the apparatus body 2. The sheet-conveying guide 105 serves to guide conveyance of the sheets P by the sheet-feed roller 104 toward the photosensitive drum 17. Specifically, the second wall 112 of the apparatus body 2 and the first wall 109 of the body portion 70 of the waste toner container 29 constitute a portion of the sheet-conveying guide 105 when the process cartridge 3 (with the waste toner container 29 mounted on the drum frame 12) is attached to the apparatus body 2. In other words, the sheet conveying guide 105 includes the second wall 112 of the apparatus body 2 and the first wall 109 of the process cartridge 3. The second wall 112 is an example of a body wall, and the first wall 109 is an example of a container wall.

When the process cartridge 3 having the waste toner container 29 mounted on the drum frame 12 is attached to the apparatus body 2, the second wall 112 faces the first wall 109 of the toner cartridge 9 to be spaced apart therefrom. Preferably, as in the present embodiment, the second wall 112 is positioned below the mounted process cartridge 3. The second wall 112 is positioned opposite to the toner container 28 with respect to the waste toner container 29 in the crossing direction B. In other words, the toner container 28 of the toner cartridge 9 is disposed opposite to the second wall 112 with respect to the waste toner container 29. The second wall 112 includes an opening 132. Put another way, the sheet-conveying guide 105 includes the opening 132.

The opening 132 is formed to penetrate through the second wall 112 in the crossing direction B. The opening 132 is arranged to be aligned with the waste toner container 29 in the crossing direction B. The opening 132 is provided so as to allow the sheets P guided along the reverse sheet-conveying guide 130 to pass through the opening 132.

Figure 10:
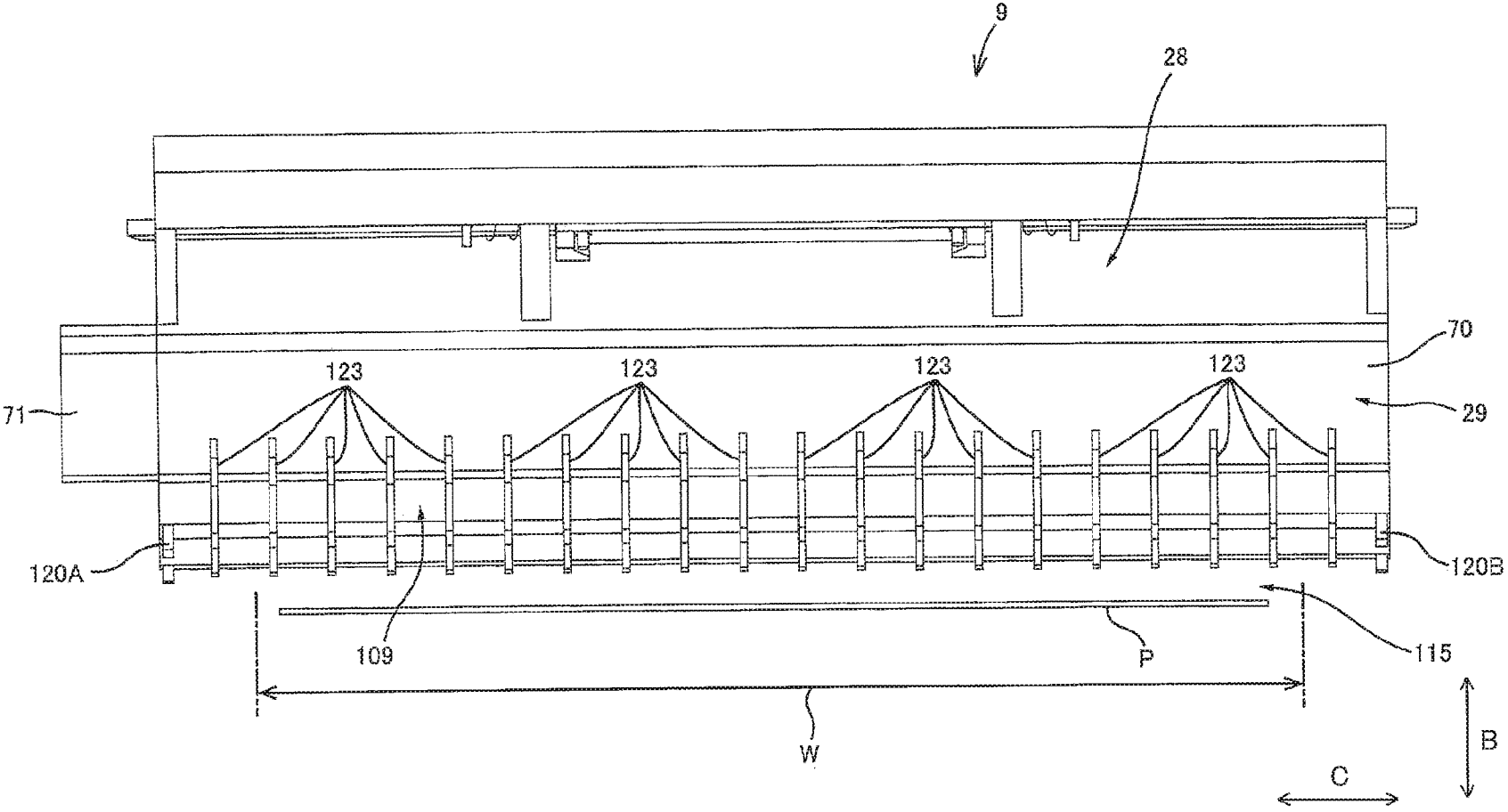
FIG. 10 is a front view of the toner cartridge according to the first embodiment shown in FIG. 2A.

The waste toner container 29 of the toner cartridge 9 constitutes a part of the sheet-conveying guide 105, as described earlier. Specifically, as illustrated in FIGS. 2A and 10, the waste toner container 29 includes the first wall 109, a first spacer 120A, a second spacer 120B, and a plurality of guide ribs 123.

The first wall 109 constitutes a part of the sheet-conveying guide 105, as described earlier. As illustrated in FIG. 2A, the first wall 109 is positioned opposite to the toner container 28 with respect to the auger screw 72 in the crossing direction B. Preferably, as in the embodiment, the first wall 109 is the lower wall constituting the body portion 70. The first wall 109 extends in the attachment/detachment direction A. As illustrated in FIGS. 1 and 2A, the first wall 109 includes a first guide portion 125 and a second guide portion 126.

The first guide portion 125 is positioned opposite to the photosensitive drum 17 with respect to the conveying portion 89 in the attachment/detachment direction A. The first guide portion 125 is recessed in the first wall 109 toward the toner container 28 in the crossing direction B. In other words, the first guide portion 125 is a recess that is recessed toward the inside of the waste toner container 29. The first guide portion 125 has an arcuate shape in a cross-sectional view. The first guide portion 125 extends in the axial direction C.

The second guide portion 126 is positioned between the conveying portion 89 and the first guide portion 125 in the attachment/detachment direction A. The second guide portion 126 is recessed in the first wall 109 toward the toner container 28 in the crossing direction B. In other words, the second guide portion 126 is a recessed portion that is recessed toward the inside of the waste toner container 29. The second guide portion 126 has an arcuate shape in a cross-sectional view. The second guide portion 126 extends in the axial direction C. When the process cartridge 3 (with the waste toner container 29 mounted on the drum frame 12) is mounted in the apparatus body 2, the second guide portion 126 faces the opening 132 of the second wall 112 in the crossing direction B.

As illustrated in FIG. 10, the first spacer 120A is positioned at an end of the body portion 70 in the axial direction C, the end being closer to the protruding portion 71 than another end of the body portion 70 is to the protruding portion 71 in the axial direction C. The second spacer 120B is positioned at the other end of the body portion 70 in the axial direction C, the other end being farther away from the protruding portion 71 than the one end is from the protruding portion 71 in the axial direction C. The second spacer 120B is arranged to be spaced apart from the first spacer 120A in the axial direction C by a distance that is equal to or larger than a length of the roller body 25B in the axial direction C.

As illustrated in FIGS. 2A and 2B, the first spacer 120A and second spacer 120B are positioned between the first guide portion 125 and second guide portion 126 in the attachment/detachment direction A. The first spacer 120A and second spacer 120B protrude downward from the first wall 109. The first spacer 120A and second spacer 120B are in contact with the second wall 112 provided at the apparatus body 2, when the process cartridge 3 having the waste toner container 29 mounted on the drum frame 12 is mounted in the apparatus body 2, as illustrated in FIG. 1.

Incidentally, when the process cartridge 3 with the waste toner container 29 mounted on the drum frame 12 is mounted in the apparatus body 2, the first and second spacers 120A and 120B in contact with the second wall 112 secure a space between the first wall 109 and the second wall 112, the space serving as a sheet-conveying path 115 between the second wall 112 and the first wall 109 of the waste toner container 29. Each sheet P is configured to be conveyed along the sheet-conveying path 115. In other words, the sheet-conveying guide 105 defines the sheet-conveying path 115 for guiding the sheets P. Note that, in the crossing direction B, the sheet-conveying path 115 does not overlap a portion at which the waste toner container 29 and the conveying pipe 22 are connected ("connecting portion"). In other words, the connecting portion between the waste toner container 29 and the conveying pipe 22 does not overlap the sheet-conveying path 115 in a direction orthogonal to the axial direction C.

Further, as shown in FIGS. 9 and 10, in the sheet-conveying path 115, the first spacer 120A and second spacer 120B define therebetween a distance that is larger than a maximum sheet width W in the axial direction C. Here, the maximum sheet width W is a maximum width of a sheet P that can be used for printing in the image-forming apparatus 1.

As illustrated in FIGS. 2A and 10, the plurality of guide ribs 123 are arranged between the first and second spacers 120A and 120B in the axial direction C. The plurality of guide ribs 123 are arrayed at intervals in the axial direction C.

The guide ribs 123 protrude downward from the first wall 109. The guide ribs 123 extend along the first guide portion 125 and the second guide portion 126 of the first wall 109. The guide ribs 123 do not protrude further (downward) relative to the first and second spacers 120A and 120B from the first wall 109. In other words, the first and second spacers 120A and 120B protrude further from the first wall 109 than the guide ribs 123 does from the first wall 109. When the process cartridge 3 (with the waste toner container 29 mounted on the drum frame 12) is mounted on the apparatus body 2, the guide ribs 123 can guide passage of the sheets P along the sheet-conveying path 115.

7-2. Sheet-Supply Portion 140

As illustrated in FIG. 1, the sheet-supply portion 140 is provided at the cover 6. Preferably, as in the embodiment, the sheet-supply portion 140 is positioned at a lower end portion of the cover 6. The sheet supplying portion 140 is positioned between the waste toner container 29 and the sheet-feed roller 104 in the crossing direction B. The sheet supplying portion 140 does not overlap the waste toner container 29 in the crossing direction B. In other words, assuming that the photosensitive drum 17, the developing roller 25, and the waste toner container 29 are arranged in a prescribed direction (which is horizontal in the present embodiment), the sheet-supply portion 140 is disposed so as not to overlap the waste toner container 29 when viewed in a direction orthogonal to both of the axial direction C and the prescribed direction. The sheet-supply portion 140 is configured of two plates positioned spaced apart from each other in the crossing direction B. The sheet-supply portion 140 is adapted to feed sheets P to the sheet-conveying guide 105 from the outside of the apparatus body 2.

7-3. Reverse Sheet-Conveying Path 117

The plurality of discharge rollers 135 are positioned opposite to the sheet tray 36 with respect to the fixing device 33 in the crossing direction B. The plurality of discharge rollers 135 is configured to discharge the sheets P, which is conveyed along the sheet-conveying path 115, to the sheet-discharge tray 35. Further, according to control by a controller (not illustrated), the plurality of discharge rollers 135 is configured to redirect a sheet P, without discharging the sheet P, such that the sheet P moves back inside the apparatus body 2.

The reverse sheet-conveying guide 130 serves to reverse the sheet P, on whose one surface a toner image has been transferred from the photosensitive drum 17, and to convey the sheet P back toward the photosensitive drum 17 for further image formation on another surface of the sheet P opposite the one surface thereof. The sheet P conveyed by the reverse sheet-conveying guide 130 is configured to face the photosensitive drum 17 subsequently. Specifically, the reverse sheet-conveying guide 130 extends from the discharge rollers 135, passes between the fixing device 33 and the sheet tray 36, while making a curve, and reaches the opening 132. Preferably, as in the embodiment, the reverse sheet-conveying guide 130 extends up to a position below the process cartridge 3. The opening 132 faces the second guide portion 126 of the toner cartridge 9 when the process cartridge 3 is attached to the apparatus body 2. In other words, the second guide portion 126 is formed at such a position on the first wall 109 of the waste toner container 29 that the second guide portion 126 can face the opening 132. The second guide portion 126 serves to guide conveyance of the sheet P from the reverse sheet-conveying guide 130 toward the photosensitive drum 17.

8. Conveyance of Sheets P

As illustrated by a solid line in FIG. 1, the sheet P picked up by the sheet-feed roller 104 is guided into the sheet-conveying path 115 along the first guide portion 125 of the first wall 109 of the waste toner container 29.

At this time, the sheet P passes between the first spacer 120A and second spacer 120B in the axial direction C, as illustrated in FIG. 10. Further, the sheet P passes through the sheet-conveying path 115 while being in contact with the plurality of guide ribs 123.

Then, as the sheet P passes between the photosensitive drum 17 and the transfer roller 18 as illustrated in FIG. 1, a toner image is transferred to one surface of the sheet P.

The sheet P subsequently passes through the fixing device 33, whereby the toner image transferred to the one surface of the sheet P is thermally fixed.

The sheet P is discharged onto the sheet-discharge tray 35 in accordance with rotation of the discharge rollers 135.

If further image formation needs to be made on the other surface of the sheet P, the discharge rollers 135 are rotated in a reverse direction, thereby conveying the sheet P toward the opening 132 through the reverse sheet-conveying path 117.

The sheet P is then guided, along the second guide portion 126 of the first wall 109 of the waste toner container 29, again into the sheet-conveying path 115.

The sheet P passes between the photosensitive drum 17 and the transfer roller 18, whereby a toner image is transferred to the other surface of the sheet P. The toner image transferred to the other surface of the sheet P is then thermally fixed by the fixing device 33.

The sheet P is finally discharged to the sheet-discharge tray 35, as the discharge rollers 135 are rotated.

9. Operational and Technical Advantages (1) According to the image-forming apparatus 1, the waste toner container 29 constitutes a part of the sheet-conveying guide 105 when the process cartridge 3 (with the waste toner container 29 mounted on the drum frame 12) is mounted on the apparatus body 2, as illustrated in FIG. 1.

Compared to a configuration in which a member separate from the waste toner container 29 is provided to constitute a part of the sheet-conveying guide 105, the structure of the present embodiment can require a smaller number of parts and achieve downsizing of the image-forming apparatus 1.

Further, when the waste toner container 29 is mounted on the drum frame 12, the waste toner container 29 is disposed opposite to the photosensitive drum 17 with respect to the developing roller 25. Furthermore, the waste toner container 29 is mountable on and detachable from the drum frame 12.

If the sheet P is jammed somewhere in the sheet-conveying guide 105, particularly at a position where the sheet P having just been fed is likely to be jammed, the toner cartridge 9 including the waste toner container 29 can be separated from the drum frame 12, as illustrated in FIG. 12. As a result, the sheet P jammed in the sheet-conveying guide 105 can be exposed to the outside.

The jammed sheet P can be easily removed from the sheet-conveying guide 105.

(2) According to the image-forming apparatus 1, when the process cartridge 3 (with waste toner container 29 mounted on the drum frame 12) is mounted in the apparatus body 2 as illustrated in FIG. 1, the first wall 109 of the waste toner container 29 and the second wall 112 of the apparatus body 2 face each other with a gap defined therebetween.

Accordingly, the first wall 109 and the second wall 112 can reliably guide the sheet P that is conveyed toward the photosensitive drum 17 by the sheet-feed roller 104.

(3) According to the image-forming apparatus 1, when the process cartridge 3 is attached to the apparatus body 2, the first spacer 120A and second spacer 120B protrude from the first wall 109 and are in contact with the second wall 112, as illustrated in FIGS. 1 and 10.

This structure can reliably secure the gap defined between the second wall 112 and the first wall 109.

(4) According to the image-forming apparatus 1, as illustrated in FIGS. 1 and 10, the first spacer 120A and second spacer 120B are disposed to be spaced away from each other by a distance that is equal to or larger than the length of the roller body 25B in the axial direction C. The length of the roller body 25B in the axial direction C is larger than the length of the sheet P in the axial direction C.

That is, the sheets P can reliably pass between the first spacer 120A and second spacer 120B while the sheet-conveying guide 105 guides conveyance of the sheet P.

The first and second spacers 120A and 120B do not hinder conveyance of the sheet P but can guide the sheets P smoothly.

(5) According to the image-forming apparatus 1, the guide ribs 123 serve to guide the conveyance of the sheet P passing through the sheet-conveying path 115, as illustrated in FIGS. 1 and 10.

Since the guide ribs 123 are adapted to guide the sheet P passing the sheet-conveying path 115, friction on the sheet P against the first wall 109 of the waste toner container 29 can be lower, than if the sheet P were guided along the first wall 109 without the guide ribs 123. This structure of the embodiment can thus realize smooth conveyance of the sheet P.

(6) According to the image-forming apparatus 1, the first and second spacers 120A and 120B protrude from the first wall 109 further relative to the guide ribs 123, as illustrated in FIGS. 1 and 10. In other words, with respect to the first wall 109, the first and second spacers 120A and 120B have a protruding length larger than a protruding length of the guide ribs 123 in the crossing direction B.

The first and second spacers 120A and 120B can be reliably made in contact with the second wall 112 when the process cartridge 3 having the toner cartridge 9 mounted on the drum cartridge 7 is attached to the apparatus body 2.

With this structure of the present embodiment, with the waste toner container 29 provided with the guide ribs 123, a gap (space) can be secured between the second wall 112 and the first wall 109.

(7) According to the image-forming apparatus 1, as illustrated in FIG. 1, the reverse sheet-conveying guide 130 is configured to reverse the sheet P having one surface on which a toner image was transferred from the photosensitive drum 17, and guide the sheet P such that the other surface of the sheet P can face the photosensitive drum 17.

The sheet P guided by the reverse sheet-conveying guide 130 passes the opening 132 and is then guided by the sheet-conveying guide 105. Then, to the other surface of the sheet P having been guided by the sheet-conveying guide 105, another toner image is transferred from the photosensitive drum 17.

Toner images can be transferred to both of the surfaces of the sheet P.

(8) According to the image-forming apparatus 1, the second guide portion 126 is provided, in the first wall 109, at a position facing the opening 132, as illustrated in FIG. 1.

The sheet P having passed through the opening 132 can be reliably guided by the second guide portion 126 to be fed to the photosensitive drum 17 from the reverse sheet-conveying guide 130.

(9) According to the image-forming apparatus 1, the second guide portion 126 is formed as a recessed portion that is recessed toward the inside of the waste toner container 29, as illustrated in FIGS. 1 and 2A.

The second guide portion 126 having a simple structure can reliably guide the sheet P having passed through the opening 132.

(10) According to the image-forming apparatus 1, the toner container 28 is disposed opposite to the second wall 112 with respect to the waste toner container 29, when the toner cartridge 9 is attached to the apparatus body 2, as illustrated in FIG. 1.

Accordingly, toner supply from the toner container 28 and conveyance of waste toner to the waste toner container 29 can be stably performed without resisting the gravitational force. The toner container 28 and the waste toner container 29 can be efficiently disposed in this way.

(11) According to the image-forming apparatus 1, the sheet-supply portion 140 can supply sheets P to the sheet-conveying guide 105 from the outside of the apparatus body 2, as illustrated in FIG. 1. That is, the sheet-supply portion 140 can feed the sheets P to the photosensitive drum 17 from the outside of the apparatus body 2.

(12) According to the image-forming apparatus 1, as illustrated in FIG. 9, the connecting portion between the waste toner container 29 and the conveying pipe 22 does not overlap the sheet-conveying path 115 in a direction orthogonal to the axial direction C. Put another way, the connecting portion is positioned outside of the sheet-conveying path 115 in the axial direction C.

With this structure, the connecting portion between the waste toner container 29 and the conveying pipe 22 does not obstruct the conveyance of the sheet P, while achieving downsizing of the apparatus body 2.

(13) According to the image-forming apparatus 1, the waste toner container 29 can be fixed to the apparatus body 2, while the developing device 13 is movable relative to the photosensitive drum 17.

That is, the sheet-conveying guide 105 does not move during the conveyance of the sheets P.

As a result, the sheets P can be stably conveyed in the image-forming apparatus 1.

Second Embodiment

A second embodiment of the disclosure will be described with reference to FIGS. 13 and 14. In the second embodiment, like parts and components are designated with the same reference numerals as those of the first embodiment to avoid duplicating explanation.

In the process cartridge 3 of the first embodiment, as illustrated in FIGS. 1 and 12, the toner cartridge 9 including the waste toner container 29 can be mounted on and detached from the drum cartridge 7.

Figure 13:
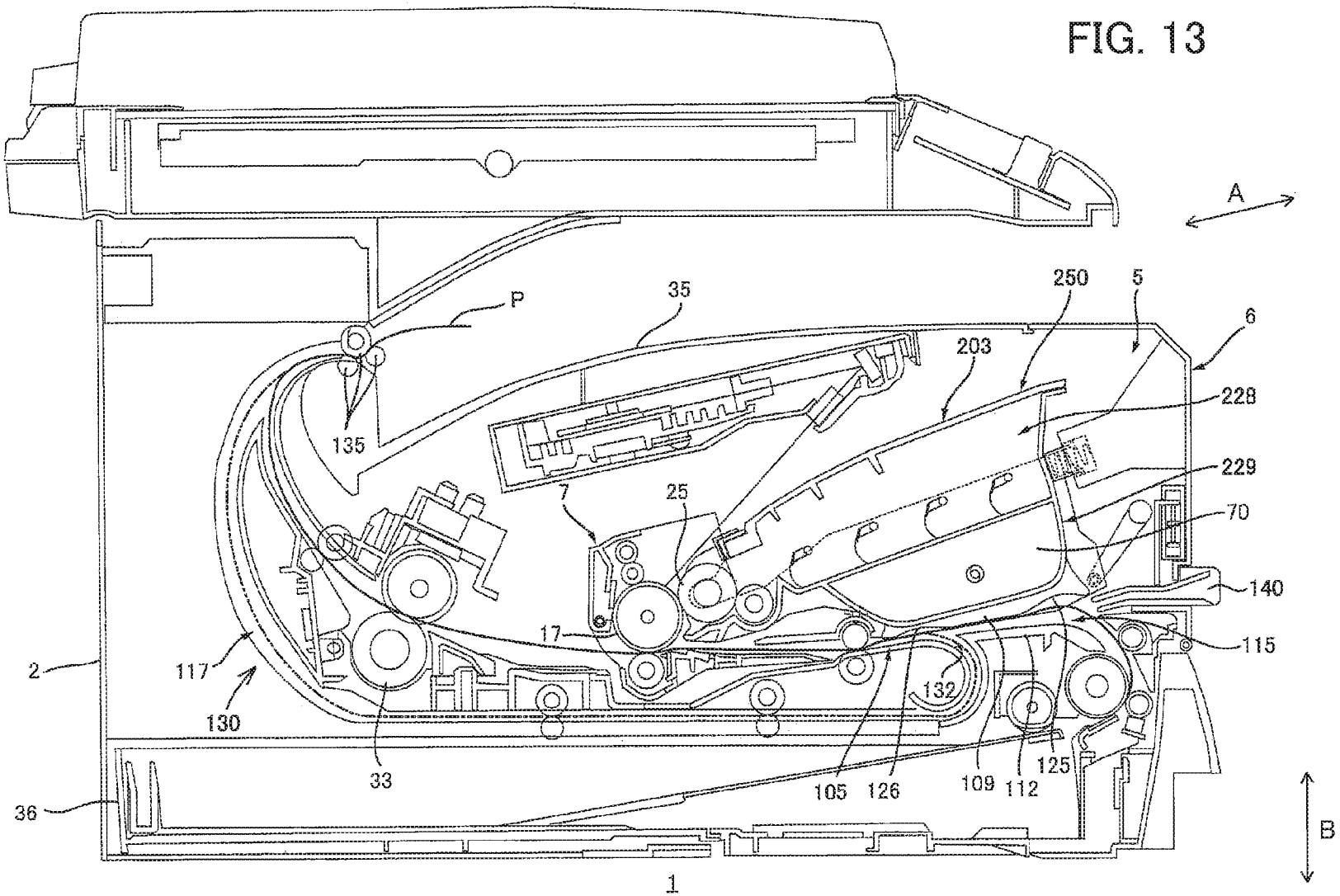
FIG. 13 is a central cross-sectional view of an image-forming apparatus according to a second embodiment.
Figure 14:
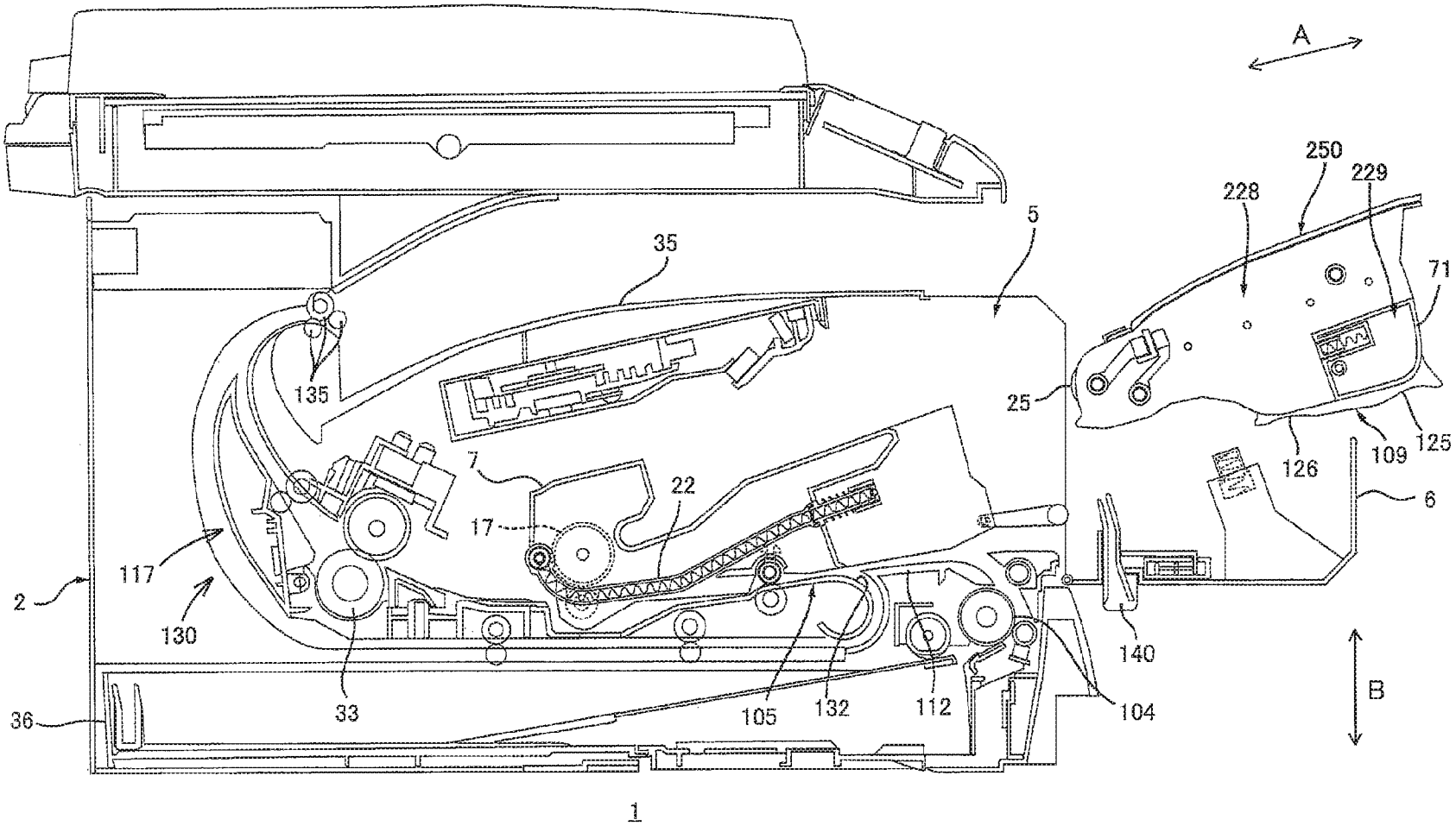
FIG. 14 is an explanatory view illustrating attachment/detachment of a toner cartridge relative to a drum cartridge in the image-forming apparatus according to the second embodiment shown in FIG. 13.

In contrast, in the second embodiment, as illustrated in FIGS. 13 and 14, a process cartridge 203 includes the drum cartridge 7 and a developing cartridge 250 that is mountable on and detachable from the drum cartridge 7.

The developing cartridge 250 includes the developing roller 25. Further, the developing cartridge 250 integrally includes a toner container 228 and a waste toner container 229. The developing cartridge 250 including the waste toner container 229 can be mounted on and detached from the drum cartridge 7.

The toner container 228 and the waste toner container 229 are aligned in the crossing direction B. Preferably, as in the second embodiment, the waste toner container 229 is positioned below the toner container 228. The waste toner container 229 includes the first wall 109 as in the first embodiment.

The first wall 109 of the waste toner container 229 of the developing cartridge 250 constitutes a part of the sheet-conveying guide 105 for guiding the sheets P, when the process cartridge 3 having the developing cartridge 250 is mounted in the apparatus body 2.

The same operational and technical advantages as the first embodiment can also be obtained in this second embodiment.

Third Embodiment

A third embodiment of the disclosure will be described with reference to FIGS. 15 and 16. In the third embodiment, like parts and components are designated with the same reference numerals as those of the first embodiment to avoid duplicating explanation.

In the above-described first and second embodiments, the toner container 28(228) and the waste toner container 29(229) are integrally formed, as illustrated in FIGS. 1 and 13.

Figure 15:
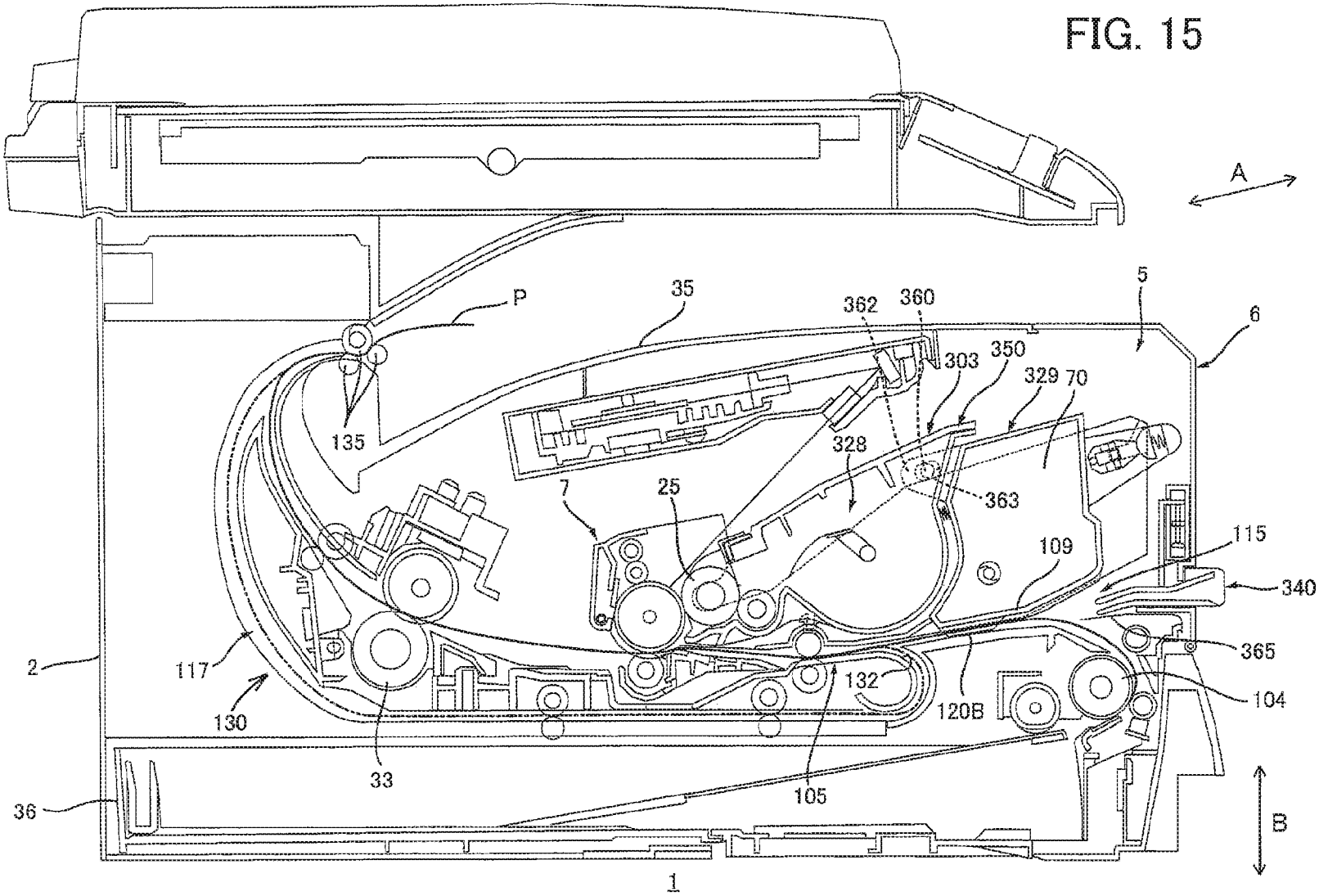
FIG. 15 is a central cross-sectional view of an image-forming apparatus according to a third embodiment.
Figure 16:
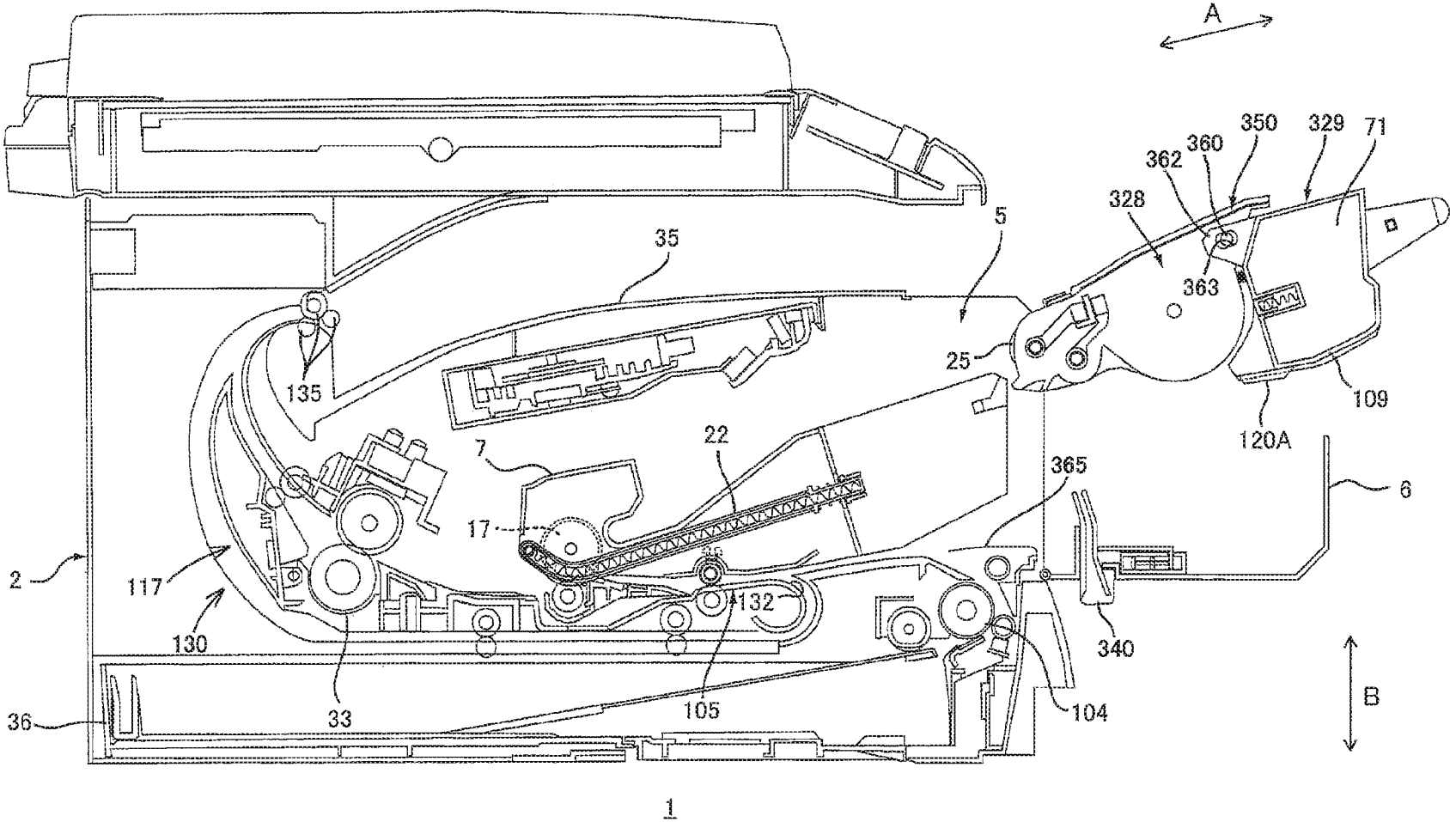
FIG. 16 is an explanatory view illustrating attachment/detachment of a toner cartridge relative to a drum cartridge in the image-forming apparatus according to the third embodiment shown in FIG. 15.

In contrast, a toner container 328 and a waste toner container 329 of the third embodiment are formed separately from each other, as illustrated in FIGS. 15 and 16.

That is, in a process cartridge 303 of the third embodiment, the waste toner container 329 is separately provided from the toner container 328; and the waste toner container 329 is pivotably connected to a developing cartridge 350.

Specifically, the toner container 328 includes side walls each including a protruding portion 360. The protruding portions 360 extend in the axial direction C.

The waste toner container 329 is positioned opposite to the developing roller 25 with respect to the toner container 328 in the attachment/detachment direction A. The waste toner container 329 is positioned to overlap with the toner container 328 in the attachment/detachment direction A. The waste toner container 329 includes two arms 362.

The two arms 362 are positioned spaced apart from each other in the axial direction C. The toner container 328 is located between the two arms 362.

The arms 362 extend toward the developing cartridge 350 in the attachment/detachment direction A. The arms 362 are aligned with the side walls constituting the toner container 328 in the axial direction C. Each of the arms 362 includes a hole 363.

The hole 363 penetrates through a generally center portion of the corresponding arm 362 in the axial direction C. The hole 363 is elongated in the attachment/detachment direction A.

Further, the hole 363 of each arm 362 receives the corresponding protruding portion 360.

With this structure, the waste toner container 329 is connected to the developing cartridge 350 so as to be pivotable about the protruding portions 360.

In this way, the waste toner container 329 can be detachably mounted on the drum cartridge 7, together with the developing cartridge 350.

Further, the waste toner container 329 includes the first wall 109 of the first embodiment. The first wall 109 of the waste toner container 329 constitutes a part of the sheet-conveying guide 105 for guiding conveyance of the sheets P, when the process cartridge 3 (with the developing cartridge 350 and the waste toner container 329 mounted on the drum cartridge 7) is mounted in the apparatus body 2.

Further, in the third embodiment, a sheet-supply portion 340 includes an assistive portion 365.

The assistive portion 365 extends toward the waste toner container 329 from the lower end portion of the cover 6. Preferably, as in the third embodiment, the assistive portion 365 extends up to a position above the sheet-feed roller 104, when the cover 6 is in the closed position. The assistive portion 365 overlaps the mounted waste toner container 329 in the crossing direction B. Put another way, assuming that the photosensitive drum 17, the developing roller 25, and the waste toner container 329 are arranged in a prescribed direction (which is horizontal in the present embodiment), at least part of the sheet-supply portion 340 is disposed to overlap with the waste toner container 329 when viewed in a direction orthogonal to both of the axial direction C and the prescribed direction. In other words, the sheet-supply portion 340 has a portion (assistive portion 365) that overlaps with the waste toner container 329 in the direction orthogonal to both of the axial direction C and the prescribed direction.

Accordingly, the sheet-supply portion 340 can reliably guide the sheet P picked up by the sheet-feed roller 104 into the sheet-conveying path 115.

The same operational and technical advantages as the first and second embodiments can also be obtained in the third embodiment.

<Modification>

In the depicted first embodiment, the waste toner removed from the peripheral surface of the photosensitive drum 17 is conveyed to the waste toner container 29 by the conveying member 53 having a spiral shape, as illustrated in FIGS. 8 and 9.

However, structures different from the structure of the depicted embodiments may be conceivable to convey the waste toner removed from the peripheral surface of the photosensitive drum 17 to the waste toner container 29.

Figure 17:
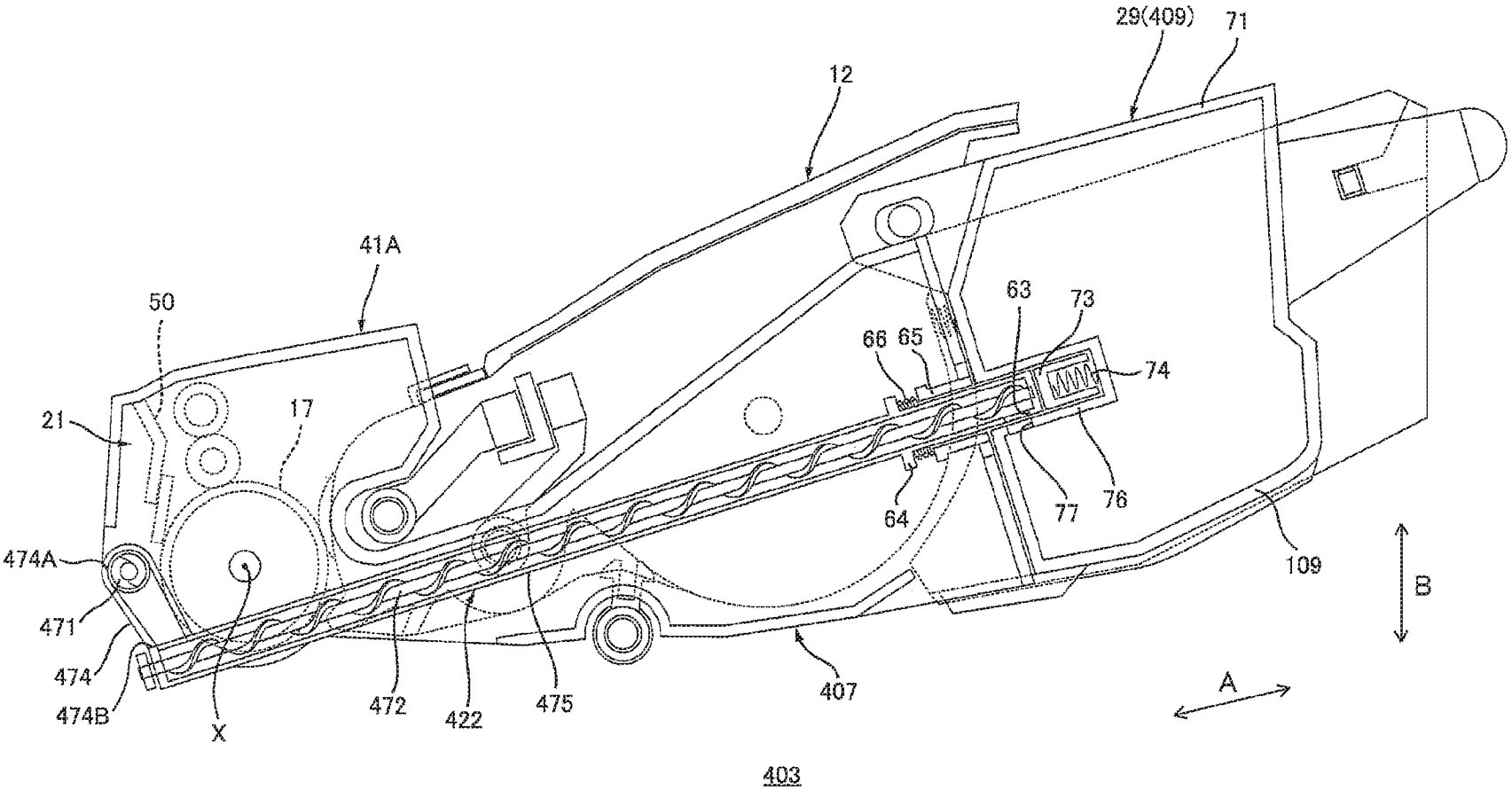
FIG. 17 is a cross-sectional side view of a process cartridge according to a modification to the first embodiment.

As an example, FIG. 17 shows a process cartridge 403 according to a modification to the first embodiment. The process cartridge 403 includes a drum cartridge 407 and a toner cartridge 409.

The drum cartridge 407 includes a first auger screw 471 and a second auger screw 472, instead of the conveying member 53. Further, a conveying pipe 422 of the modification includes a first pipe 474 and a second pipe 475.

The first pipe 474 extends in the crossing direction B. The first pipe 474 has one end portion 474A that is connected to the side wall 41A and communicates with the cleaning frame 50. The first pipe 474 has another end portion 474B opposite to the one end portion 474A. The other end portion 474B of the first pipe 474 is positioned farther away from the cleaner 21 than one end portion 474A of the first pipe 174 is from the cleaner 21. Preferably, as in the present modification, the other end portion 474B of the first pipe 174 is positioned below one end portion 474A.

The second pipe 475 is connected to the other end portion 474B of the first pipe 474. The second pipe 475 extends from the other end portion 474B of the first pipe 474 up to the receiving cylinder 76 of the protruding portion 71 of the toner cartridge 409 in the attachment/detachment direction A. The second pipe 475 is a substantially linear and tubular pipe. The second pipe 475 includes the discharge port 63 as in the first embodiment.

The first auger screw 471 is provided in the cleaning frame 50. The first auger screw 471 extends in the axial direction C.

The second auger screw 472 is positioned in the second pipe 475. The second auger screw 472 has one end portion in the attachment/detachment direction A that faces the other end portion 474B of the first pipe 474. The second auger screw 472 has another end portion in the attachment/detachment direction A that faces the discharge port 63.

Waste toner scraped off the peripheral surface of the photosensitive drum 17 and stored in the cleaning frame 50 is conveyed toward the first pipe 474 by the first auger screw 471.

The waste toner conveyed to the first pipe 474 falls within the first pipe 474 and flows into the second pipe 475.

The waste toner falling into the second pipe 475 is then conveyed toward the protruding portion 71 of the waste toner container 29 by the second auger screw 472.

The waste toner conveyed to the protruding portion 71 in this way is then stored in the waste toner container 29 of the toner cartridge 409.

The same operational and technical advantages as the first embodiment can also be obtained in this modification.

While the disclosure is described in detail with reference to the specific embodiments thereof while referring to accompanying drawings, it would be apparent to those skilled in the art that many modifications and variations may be made therein without departing from the spirits of the disclosure.

What is claimed is:

1. An image-forming apparatus comprising:

an apparatus body comprising:

a sheet-feed roller; and a body wall;

a process cartridge attachable to and detachable from the apparatus body, the process cartridge comprising:

a photosensitive drum rotatable about an axis extending in an axial direction; and a cleaner configured to remove waste toner from a peripheral surface of the photosensitive drum; and a waste-toner container for storing the waste toner removed by the cleaner, the waste-toner container being attachable to and detachable from the process cartridge, the waste-toner container including a container wall, wherein, when the waste-toner container is attached to the process cartridge and the process cartridge is attached to the apparatus body, the body wall of the apparatus body and the container wall of the waste-toner container constitute a part of a sheet-conveying guide, the sheet-conveying guide being configured to guide conveyance of a sheet from the sheet-feed roller toward the photosensitive drum, and wherein the container wall of the waste-toner container comprises a rib for guiding the sheet.

2. The image-forming apparatus according to claim 1, wherein the container wall of the waste-toner container faces the body wall of the apparatus body when the waste-toner container is attached to the process cartridge and the process cartridge is attached to the apparatus body.

3. The image-forming apparatus according to claim 2, wherein the waste-toner container further includes a spacer protruding from the container wall and configured to contact the body wall when the waste-toner container is attached to the process cartridge and the process cartridge is attached to the apparatus body, the spacer in contact with the body wall providing a space between the container wall and the body wall, the space serving as a sheet conveying path for conveying the sheet.

4. The image-forming apparatus according to claim 3, wherein the process cartridge further comprises a developing roller including a shaft and a roller body provided around the shaft, and wherein the spacer comprises:

a first spacer; and a second spacer arranged to be spaced apart from the first spacer in the axial direction by a distance larger than a length of the roller body in the axial direction.

5. The image-forming apparatus according to claim 3, wherein the spacer protrudes from the container wall further relative to the rib.

6. The image-forming apparatus according to claim 2, further comprising a toner container for storing toner to be supplied to a developing roller of the process cartridge, the toner container being positioned opposite to the body wall with respect to the waste-toner container when the waste-toner container is attached to the process cartridge and the process cartridge is attached to the apparatus body.

7. The image-forming apparatus according to claim 1, further comprising a conveying pipe for conveying the waste toner removed by the cleaner, wherein, when the waste-toner container is attached to the process cartridge and the process cartridge is attached to the apparatus body, the sheet-conveying guide defines a sheet-conveying path; and the waste-toner container and the conveying pipe are connected to each other at a connecting portion, the connecting portion being positioned outside of the sheet-conveying path in the axial direction.

8. An image-forming apparatus comprising:

an apparatus body comprising:

a sheet-feed roller; and a body wall;

a drum cartridge attachable to and detachable from the apparatus body, the drum cartridge comprising:

a photosensitive drum; and a cleaner for removing waste toner from the photosensitive drum; and a waste-toner container for storing the waste toner removed by the cleaner, the waste-toner container being attachable to and detachable from the apparatus body, the waste-toner container including a container wall, wherein, when the drum cartridge and the waste-toner container are attached to the apparatus body, the body wall of the apparatus body and the container wall of the waste-toner container constitute a part of a sheet-conveying guide, the sheet-conveying guide being configured to guide conveyance of a sheet from the sheet-feed roller toward the photosensitive drum.

9. The image-forming apparatus according to claim 8, wherein the container wall of the waste-toner container faces the body wall of the apparatus body when the drum cartridge and the waste-toner container are attached to the apparatus body.

10. The image-forming apparatus according to claim 9, wherein the waste-toner container further includes a spacer protruding from the container wall and configured to contact the body wall when the drum cartridge and the waste-toner container are attached to the apparatus body, the spacer in contact with the body wall providing a space between the container wall and the body wall, the space serving as a sheet conveying path for conveying the sheet.

11. The image-forming apparatus according to claim 10, wherein the photosensitive drum is rotatable about an axis extending in an axial direction, wherein the drum cartridge further comprises a developing roller including a shaft and a roller body provided around the shaft, and wherein the spacer comprises:

a first spacer; and a second spacer arranged to be spaced apart from the first spacer in the axial direction by a distance larger than a length of the roller body in the axial direction.

12. The image-forming apparatus according to claim 9, further comprising a toner container for storing toner to be supplied to a developing roller of the drum cartridge, the toner container being positioned opposite to the body wall with respect to the waste-toner container when the drum cartridge and the waste-toner container are attached to the apparatus body.

13. The image-forming apparatus according to claim 8, further comprising a conveying pipe for conveying the waste toner removed by the cleaner, wherein, when the drum cartridge and the waste-toner container are attached to the apparatus body, the sheet-conveying guide defines a sheet-conveying path; and the waste-toner container and the conveying pipe are connected to each other at a connecting portion, the connecting portion being positioned outside of the sheet-conveying path in an axial direction in which a rotation axis of the photosensitive drum extends.

14. The image-forming apparatus according to claim 8, wherein the drum cartridge comprises a drum frame, and wherein the waste-toner container is attachable to and detachable from the drum frame.

* * * * *